United States Patent [19]

Dahlgren et al.

[11] 4,088,074

[45] May 9, 1978

[54] APPARATUS FOR INKING PRINTING PLATES

[76] Inventors: Harold P. Dahlgren, 726 Regal Row, Dallas, Tex. 75247; Harvey W. Dahlgren, P.O. Box 8234, Mobile, Ala. 36608

[21] Appl. No.: 654,321

[22] Filed: Feb. 2, 1976

Related U.S. Application Data

[63] Continuation of Ser. No. 526,486, Nov. 25, 1974, abandoned, which is a continuation-in-part of Ser. No. 251,740, May 9, 1972, abandoned.

[51] Int. Cl.[2] ..... B41L 27/08; B41L 27/16; B41L 23/04

[52] U.S. Cl. ..... 101/350; 101/148; 101/DIG. 14

[58] Field of Search ..... 101/148, 350, 351, 363, 101/364, 349, 157, 169, DIG. 14

[56] References Cited

U.S. PATENT DOCUMENTS

| | | | |
|---|---|---|---|
| 1,840,069 | 1/1932 | Walker et al. | 101/350 |
| 2,260,364 | 10/1941 | Case | 101/350 X |
| 2,972,298 | 2/1961 | Demarchi et al. | 101/350 X |
| 3,141,408 | 7/1964 | Bernardi et al. | 101/350 X |
| 3,283,712 | 11/1966 | Chambon | 101/350 |
| 3,285,169 | 11/1966 | Hartwig | 101/350 |
| 3,404,625 | 10/1968 | White | 101/363 X |
| 3,584,579 | 6/1971 | Rothenberg | 101/350 |
| 3,769,909 | 11/1973 | Fugman | 101/363 X |
| 3,857,095 | 12/1974 | Mitchie et al. | 324/71 R |
| 3,926,114 | 12/1975 | Matuschke | 101/247 X |

FOREIGN PATENT DOCUMENTS

| | | | |
|---|---|---|---|
| 2,250,877 | 7/1973 | Germany | 101/349 |
| 1,267,947 | 3/1972 | United Kingdom | 101/350 |

*Primary Examiner*—J. Reed Fisher
*Attorney, Agent, or Firm*—Lowe, King, Price & Markva

[57] ABSTRACT

An inker comprising two rollers having surfaces in pressure indented relation, adjacent surfaces moving in opposite directions to meter ink. A surface of one of the rollers carries a film of ink to the printing plate and thereafter an excessive quantity of ink is applied as the surface moves away from the printing plate and through an ink reservoir. The excessive quantity of ink is metered between the surfaces of the two rollers moving in opposite directions to form a fresh continuous uniform thickness for application to the printing plate. Viscosity of the ink in the reservoir is controlled.

17 Claims, 27 Drawing Figures

APPARATUS FOR INKING PRINTING PLATES

CROSS REFERENCE TO RELATED APPLICATIONS

This application is a continuation of our copending application Ser. No. 526,486 filed Nov. 25, 1974, now abandoned, which was a continuation-in-part of copending application Ser. No. 251,740 filed May 9, 1972, now abandoned, entitled "Method and Apparatus for Inking Printing Plates."

BACKGROUND OF INVENTION

Devices for inking lithographic printing plates generally comprise a plurality of form rolls which contact a printing plate. Each of the form rolls is usually in rolling contact with one or more vibrator rollers to which ink is applied by a large number of rollers, generally twenty or more, arranged in pyramid fashion.

Inking systems currently in use generally have rollers in the ink train of varying diameters, some of which vibrate longitudinally in an effort to eliminate ghosting and to provide desired quantities of ink to the printing plate.

The quantity of ink supplied through a train of rollers to a printing plate is generally controlled by adjusting ink keys and controlling dwell time of ductor rollers to control the input of ink to the long train of rollers. Heretofore, on a press for printing sheets thirty-eight inches wide about sixty individual inker adjustments had to be correlated. Changing a first adjustment required a change of a second which in turn required a third and usually readjustment of the first. The effect of such a change was not apparent on printed sheets for about five minutes and thus resulted in wasting excessive quantities of paper, sometimes five hundred sheets or more, while the operator adjusted the ink train by trial and error.

Since ink is applied by form rollers only to image areas of the plate, form rollers have a memory because ink accumulates on areas of the form rollers which contact non-image areas of the plate. The operator is faced with the impossible task of adjusting the inker to feed ink to the areas of the form rolls corresponding to image areas while attempting to minimize accumulation on areas corresponding to non-image areas. As a result, part of the image areas are starved and undesirable accumulation results on other parts of the rollers.

U.S. Pat. No. 3,283,712 describes an inking system devised to overcome ghosting. The system comprises two rollers urged together in pressure indented relation, opposite surfaces of adjacent rollers moving in opposite directions. All of the ink is removed from the surface of one of the rollers by doctor blades.

It has been observed that during operation of an inking system wherein adjacent surfaces of rollers move in opposite directions, heat is generated at a rate which is related to the relative surface speed of the rollers, pressure between the rollers, and the lubrication between adjacent surfaces of the rollers.

Viscosity, surface tension, cohesion of ink molecules, and adhesion of ink molecules and molecules on surfaces of rollers are all related to temperature of the ink. Inking systems heretofore devised wherein ink was metered between adjacent surfaces of rollers moving in opposite directions have not controlled temperature of the ink or temperature of the roller surfaces. Since temperature was not controlled, several parameters which determined the thickness of a "metered" ink film were not controlled. Consequently, such systems were not capable of adjustment to continuously meter an ink film of a desired thickness.

Inking systems comprising rollers having adjacent surfaces moving in opposite directions have not included structure to control lubrication between the roller surfaces. Power required to drive a roller is a function of the torque and the speed of rotation of the roller.

Torque is force resisting rotation of the roller multiplied by the radius of the roller. The force resisting rotation is a function of the force urging the surfaces of the rollers together times the coefficient of friction. The coefficient of friction between lubricated surfaces depends both on the materials and conditions of the surfaces and on the lubricant.

If the speed of the roller is sufficiently low so as not to affect temperature of the roller surface, the coefficient of friction is substantially independant of surface speed. However, when the surface speed is increased and temperature of the lubricant and of the surface of the roller increase, the coefficient of friction decreases as the velocity increases.

It has been observed that in an attempt to meter a thin film of ink between rollers having adjacent surfaces moving in opposite directions, the coefficient of sliding friction between soft materials or between a hard material and a soft material is much greater than between hard materials. If a lubricating film between a hard surface and a soft surface, moving in opposite directions, is suddenly eliminated, frictional forces of sufficient magnitude to severely damage the soft surface may be encountered.

Heretofore no method of metering ink has been devised wherein ghosting is eliminated and a film of ink of regulated thickness is delivered to a printing plate for an extended period of time.

SUMMARY OF THE INVENTION

The present invention relates to a method and apparatus for metering ink wherein the complex ink train and the large number of rollers associated therewith have been eliminated. The ink train has been replaced by an applicator roller, having an ink receptive surface in engagement with a printing plate, in combination with very simple metering apparatus for metering a fresh uniform film of ink onto the applicator roller for application to the printing plate.

Metering is accomplished by positioning rollers having ink receptive surfaces in pressure indented relation and then rotating adjacent surfaces in opposite directions. The thickness of the ink film carried by the applicator roller to the printing plate is controlled by adjusting pressure between the rollers and by adjusting the relative speed of rotation of the rollers to control force for shearing excess ink from the surface of the applicator roller.

The surface of the applicator roller is offered more ink than it is capable of carrying, thereby destroying any image retained thereon to eliminate ghosting. The abundant supply of ink is then metered through the nip between rollers in pressure indented relation and an ink film of metered thickness is carried by the applicator roller to the plate. To assure uniform metering, an ink film on the surface of the metering roller moving toward contact with the applicator roller is doctored to provide an endless uniform wiping surface of uniform consistency at the metering nip such that the thickness of the film metered between the rollers will be uniform, predictable, and controllable for a preselected relative surface speed and pressure relationship.

The viscosity and cohesion of the ink molecules, are controlled by regulating temperature of the ink and by regulating the shear rate of the ink. The adhesion of ink molecules to molecules of the metering and applicator rollers is controlled by regulating temperature over the roller surfaces and by forming the roller surfaces of materials having particular properties.

A primary object of the invention is to provide an inking system affording continuous precision control of the thickness of an ink film delivered to a printing plate.

Another object of the invention is to provide an inking system having a minimum number of ink carrying rollers, rendering the system immediately responsive to adjustment to eliminate the necessity of trial and error adjustment to establish and maintain desired quantities of ink for application to a printing plate.

Another object of the invention is to provide an inking system which is non-accumulative for eliminating variation of color as a result of irregular ink film thickness longitudinally of rollers.

Another object of the invention is to provide an inking system wherein temperature of surfaces of rollers is controlled along the length of the rollers.

A further object of the invention is to provide an inking system wherein an excessive quantity of ink is applied to the surface of an applicator roller which is moving from the surface of a printing plate to completely eliminate ghosting.

A further object of the invention is to provide an inking system having rollers in pressure indented relation, adjacent surfaces thereof moving in opposite directions, to calendar and meter a smooth ink film and to eliminate film splitting at the metering nip together with resultant lack of uniformity of film thickness.

A further object of the invention is to provide an inking system capable of applying fast drying inks; thus, eliminating the necessity for the use of ovens and spray powder and minimizing air pollution which has heretofore accompanied printing operations.

A still further object of the invention is to provide an improved end-dam construction positioned in sealing engagement with ends of rollers in an inker wherein pressure between the rollers can be changed without affecting the sealing capability of the end-dams.

A still further object of the invention is to provide a control system adapted to sense the thickness of an ink film on an applicator roller and change the speed of rotation of a metering roller in pressure indented relation with the applicator roller such that a change in the thickness of the ink film is effected immediately.

A still further object of the invention is to provide an inking system for a printing press comprising: an applicator roller and a metering roller in pressure indented relation, adjacent surfaces moving in opposite directions, wherein the printing press, the applicator roller and the metering roller are independently driven by separate drive motors; and a synchronizing mechanism is connected between the press and the applicator roller.

DESCRIPTION OF DRAWING

Drawings of a preferred embodiment of the invention are annexed hereto so that the invention may be better and more fully understood, in which:

FIG. 23A, 23B-1, 23B-2 is a wiring diagram of inker and dampener drive circuits.

Numeral references are employed to designate like parts throughout the various figures of the drawing.

DESCRIPTION OF A PREFERRED EMBODIMENT

Figure 1:
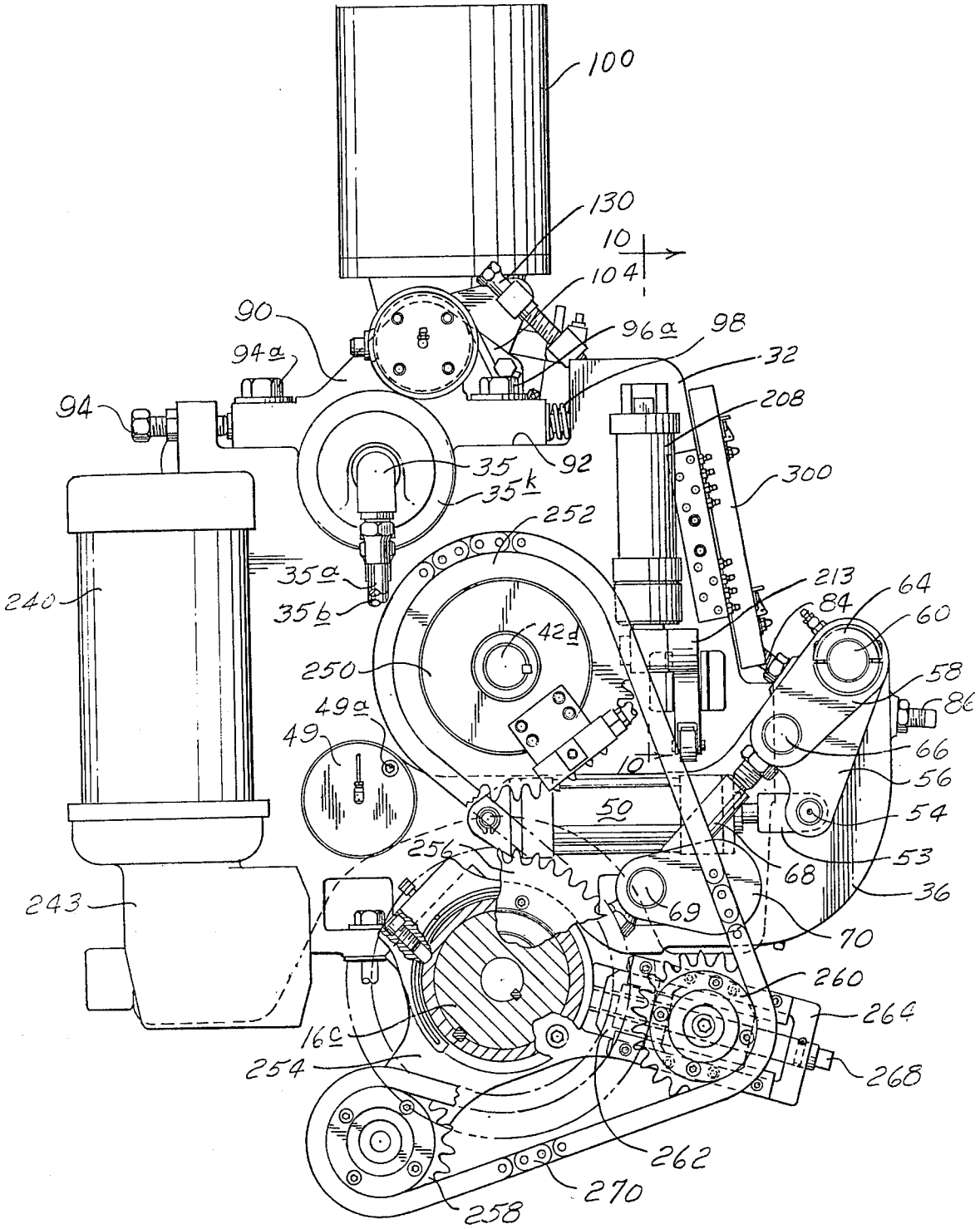
FIG. 1 is a side elevational view of the inking system as viewed from the drive side of a printing press.

Referring to FIG. 1 of the drawing, the number 30 generally designates an inker having a side frame 32 on the drive side of a printing press and a side frame 34 on the operator's side of a printing press. As will be hereinafter more full explained, the inker side frames 32 and 34 are pivotally secured to support frames 36 and 38 which are connectable to side frames on a printing press.

Side frames 32 and 34 are connected by suitable reinforcing means such as tie bars 35 to form a strong, rigid structure to which applicator roller 42 and metering roller 44 are secured. A plate cylinder 46 and a blanket cylinder (not shown) are rotatably disposed between press side frames.

The applicator roller 42 has a rigid tubular metallic core 42*a* about which is disposed a resilient, non-absorbent covering constructed of suitable material, such as plastic or rubber composition. The molecules of the ink are attracted to the molecules of surface 42*b* which permits metering of a very thin film of ink while providing optimum control.

Metering roller 44 preferably has a hard exterior surface which is receptive to the particular liquid being metered. For precision control, the liquid being metered should wet the surfaces of the applicator roller 42 and of the metering roller 44. Ink wets a surface when adhesion of the ink molecules and molecules on the surface is greater than cohesion of the ink molecules.

The surface of metering roller 44 is preferably cast iron which has an affinity for ink, such that the ink may be spread in a smooth uniform layer over the surface of the roller, and the ink will adhere tenaciously thereto.

As will be hereinafter more fully explained, the temperature of the surface of metering roller 44 and of the surface of the applicator roller 42 is controlled to maintain constant relationships of viscosity, surface tension, cohesion of ink molecules, and adhesion of ink molecules and the molecules on the roller surfaces under continuous operating conditions.

Metering roller 44 comprises a hollow cylindrical tube 44*a* constructed of gray cast iron having a central passage or bore 44*b* extending longitudinally therethrough.

Metering roller 44 may be constructed by casting tube 44*a* of cast iron, for example ASTM A48-60 gray iron casting.

The microstructure of the surface of metering roller 44 is important to the effective operation of the metering roller. If the surface is too rough, irregularities or course surface areas would puncture or break a thin film of ink deposited thereover. If the surface is too smooth, ink molecules will not adhere to the surface to form a continuous uniform film of ink about the surface of the metering roller.

The surface of metering roller 44 should be ground and polished to provide a surface having a fine finish within a range of 0.5 to 500 R.M.S. micro-inches. A surface finish of 5 micro-inches is believed to be optimum.

The surface of metering roller 44, after being polished or buffed with crocus cloth to provide the desired surface texture, has a smooth uniform uninterrupted surface with microscopic pits and indentations therein. The surface thus formed is wettable by printing ink and has a uniform affinity for the ink over the surface thereof. Otherwise expressed, the surface of the metering roller 44 is capable of carrying an extremely thin layer or film of ink in contact therewith because of the adsorptive nature of the surface.

The applicator roller 42 comprises a rigid hollow tubular metallic core 42*a* having a resilient covering 42*b* secured thereto. The surface of applicator roller 42, while being resilient, is relatively firm, for example in a range of 40–90 Shore A durometer.

The cover 42*b* on applicator roller 42 is preferably formed of a rubber-like material, such as Buna N, or a plastic material attached to the metallic core for example as described in U.S. Pat. No. 3,514,312 entitled "Process for Coating a Metal Surface". After the resilient cover 42*b* has been formed, the roller has a slick glazed outer skin or film over the surface thereof which is removed by grinding.

The surface of applicator roller 42, like the surface of metering roller 44, should have microscopic pits and indentations in the surface thereof to enhance the adhesion of ink molecules to the surface thereon. Buna N has natural pits in the surface after grinding. However, the ground plastic surface is sanded by using 400 grit sand paper to provide a very smooth, clean uniform surface. The pits and indentations are formed in the smooth resilient plastic surface on cover 42*b* by sanding the surface, for example using 180 grit sand paper, to slightly roughen the surface and to provide uniform roughness over the surface of the resilient cover 42*b*.

From the foregoing it should be readily apparent that the surface of applicator roller 42 and the surface of metering roller 44 would have microscopic indentations formed therein which form microscopic reservoirs into which ink is deposited to assure that a continuous film of ink is maintained on the surface of applicator roller 42 and on the surface of metering roller 44. As will be hereinafter more fully explained ink is metered through a nip between applicator roller 42 and metering roller 44, which are urged together in pressure indented relation, by controllably shearing ink between surfaces of rollers 42 and 44.

As best illustrated in FIGS. 1, 2, 16, and 17, means is provided to control the temperature of the surface of metering roller 44 and the surface applicator roller 42 to maintain the temperature of ink within a controlled temperature range.

Figure 16:
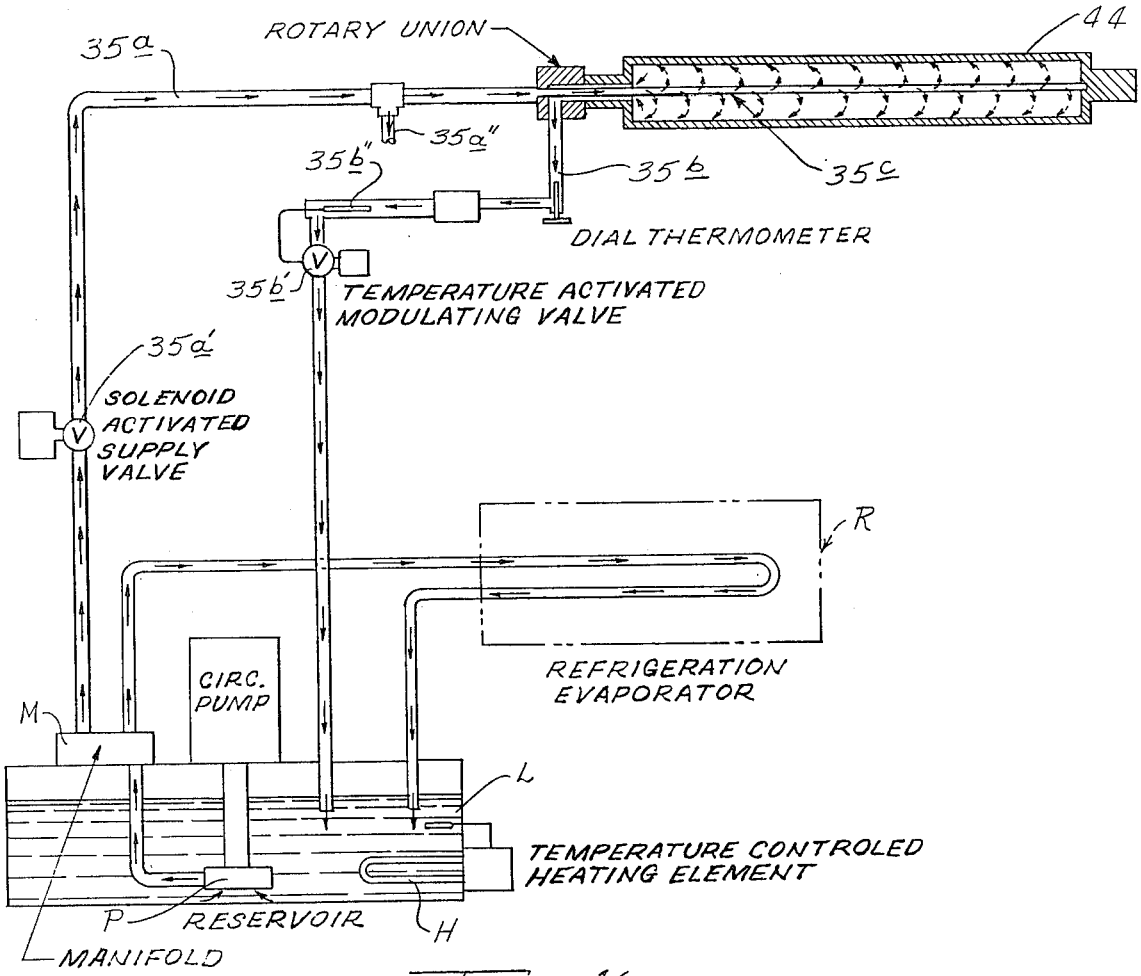
FIG. 16 is a diagrammatic view of apparatus for controlling temperature and viscosity of ink.
Figure 17:
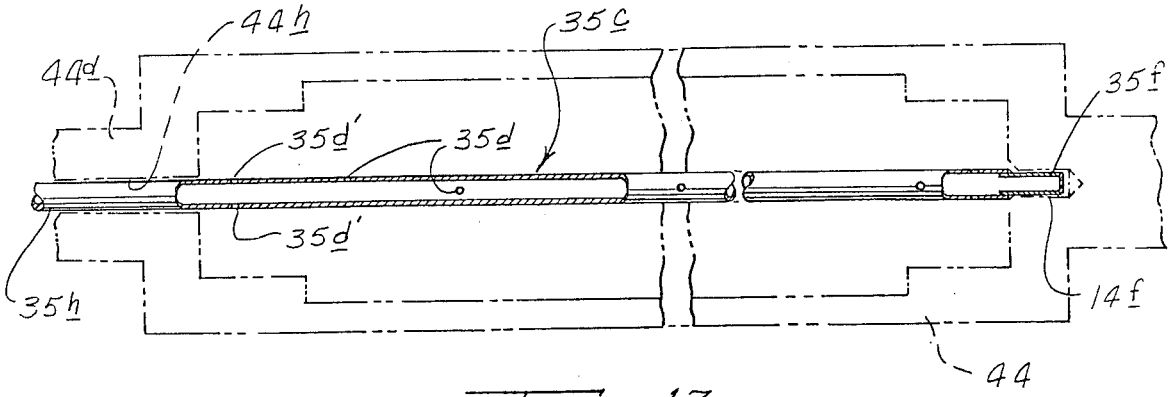
FIG. 17 is a diagrammatic view of a distribution tube mounted in a roller.

Referring particularly to FIGS. 16 and 17 of the drawing, a hollow distribution tube 35*c* having apertures 35*d* formed therein extends through the bore of metering roller 44. End 35*e* of tube 35*c* is closed by closure member 35*f* rotatably disposed in socket 44*f* formed in end plug 44*a* which extends into the bore of metering roller 44.

Distribution tube 35*c* extends through passage 44*h* formed in end plug 44*b* and the end 35*h* of the distribution tube is connected by a rotary swivel connector 35*j* to a coupling 35*k*. Coupling 35*k* is connected to fluid inlet line 35*a* and to fluid return line 35*b*. The end 35*h* of distribution tube 35*c* extends through coupling 35*k* and communicates with inlet line 35*a*.

Fluid flowing from inlet line 35*a* passes through distribution tube 35*c* into the interior of metering roller 44 through apertures 35*d*. Fluid from metering roller 44 flows through passage 44*h*, through swivel connector 35*j*, and connector 35*k* to return line 35*b*. Fluid is similarly delivered through line 35*a*" to a distribution tube (not shown) in applicator roller 42.

Means is provided for controlling the temperature and flow rate of fluid through lines 35*a*, 35*a*" and 35*b* for controlling the temperature of the surface of rollers 42 and 44.

As illustrated in FIG. 16 a suitable liquid L, for example water, is maintained at a controlled temperature by a heating element H and a refrigeration system R. The heating element H and refrigeration system R are controlled by a suitable thermostatic control apparatus (not shown) to maintain the temperature of liquid L at a desired level.

A pump P delivers liquid at a controlled temperature to a manifold M which is connected to fluid inlet line 35*a* through a solenoid actuated supply valve 35*a*'.

Fluid return line 35b is connected through a filter element F to a temperature actuated modulating valve 35b', through which liquid is returned to a reservoir.

The temperature actuated modulating valve 35b' is adapted to regulate the flow of liquid L to maintain the temperature of the liquid at a desired temperature. A typical valve 35b' is commercially available from Penn Controls, division of Johnson Service Company, temperature actuated modulating water valves, Series V 478a-3, and has a sensing bulb 35b'' connected to an actuating mechanism to open the valve on a temperature increase at the bulb 35b'' and to totally or partially close the valve in response to reduction in temperature of the bulb 35b''.

From the foregoing, it should be readily apparent that liquid L, at a controlled temperature, is delivered through apertures 35d into metering roller 44. The flow rate of liquid through return line 35b is maintained such that the temperature of liquid returned is at a controlled temperature. It should be appreciated that modulating valve 35b' controls heat transferred between the circulating liquid and rollers 42 and 44.

It should further be noted that under operating conditions, heat is not generated at a uniform rate over the surface of roller 44. Apertures 35d are arranged such that liquid is delivered to the interior of metering roller 44 such that the temperature of roller 44 is controlled along the length thereof. For example, apertures 35d' adjacent opposite ends of roller 44 are spaced closer together than apertures 35d formed in distribution tube 35c centrally of metering roller 44.

As will be hereinafter more fully explained, controlling temperature of the surface of roller 44, which is urged into pressure indented relation with the surface of applicator roller 42, controls force of adhesion between ink and the surface of metering roller 44, and also the viscosity of ink and the cohesive force between ink molecules to control shearing of ink in the nip between metering roller 44 and applicator roller 42.

Figure 3:
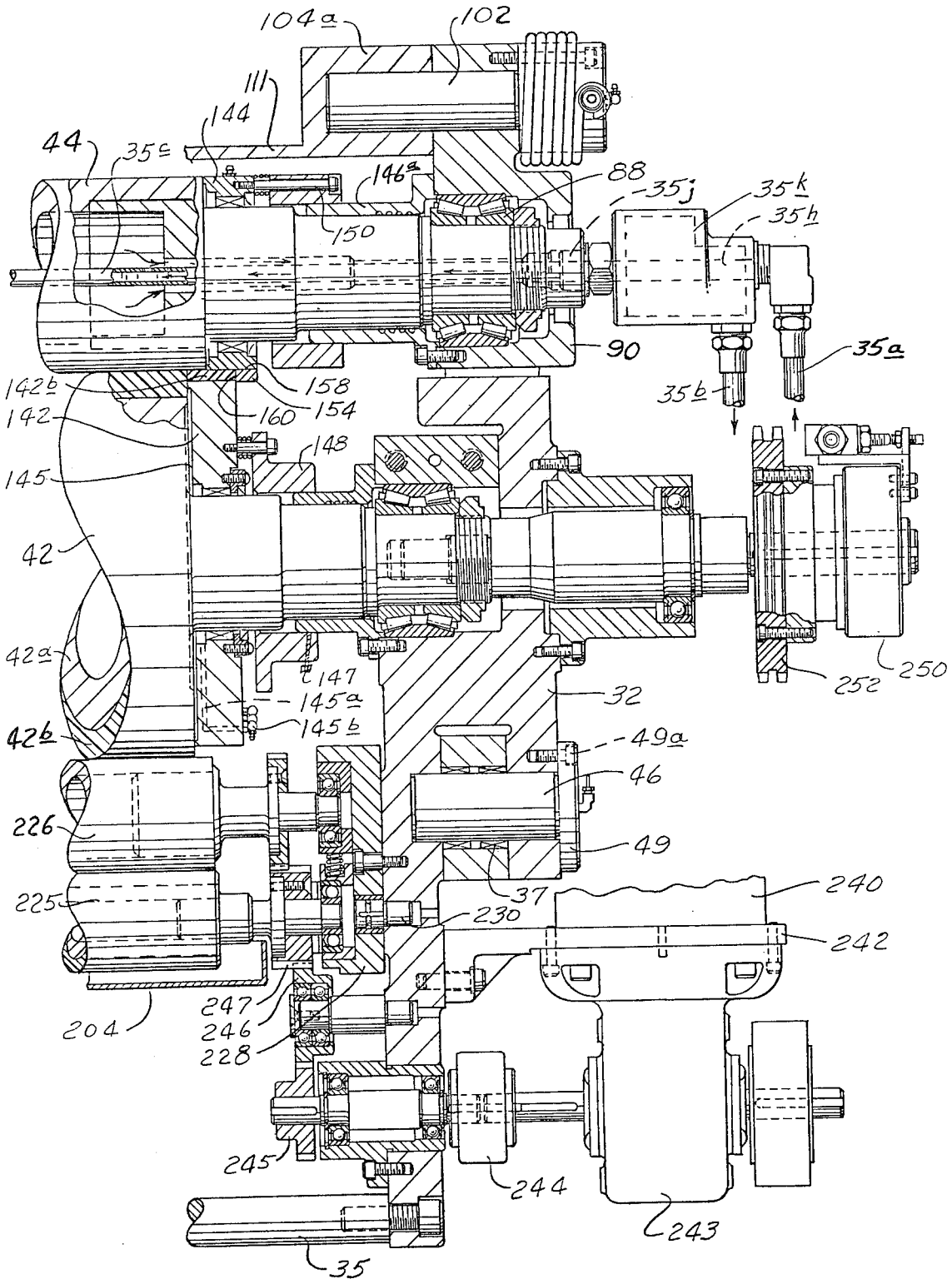
FIG. 3 is a cross-sectional view taken along line 3—3 of FIG. 2.
Figure 6:
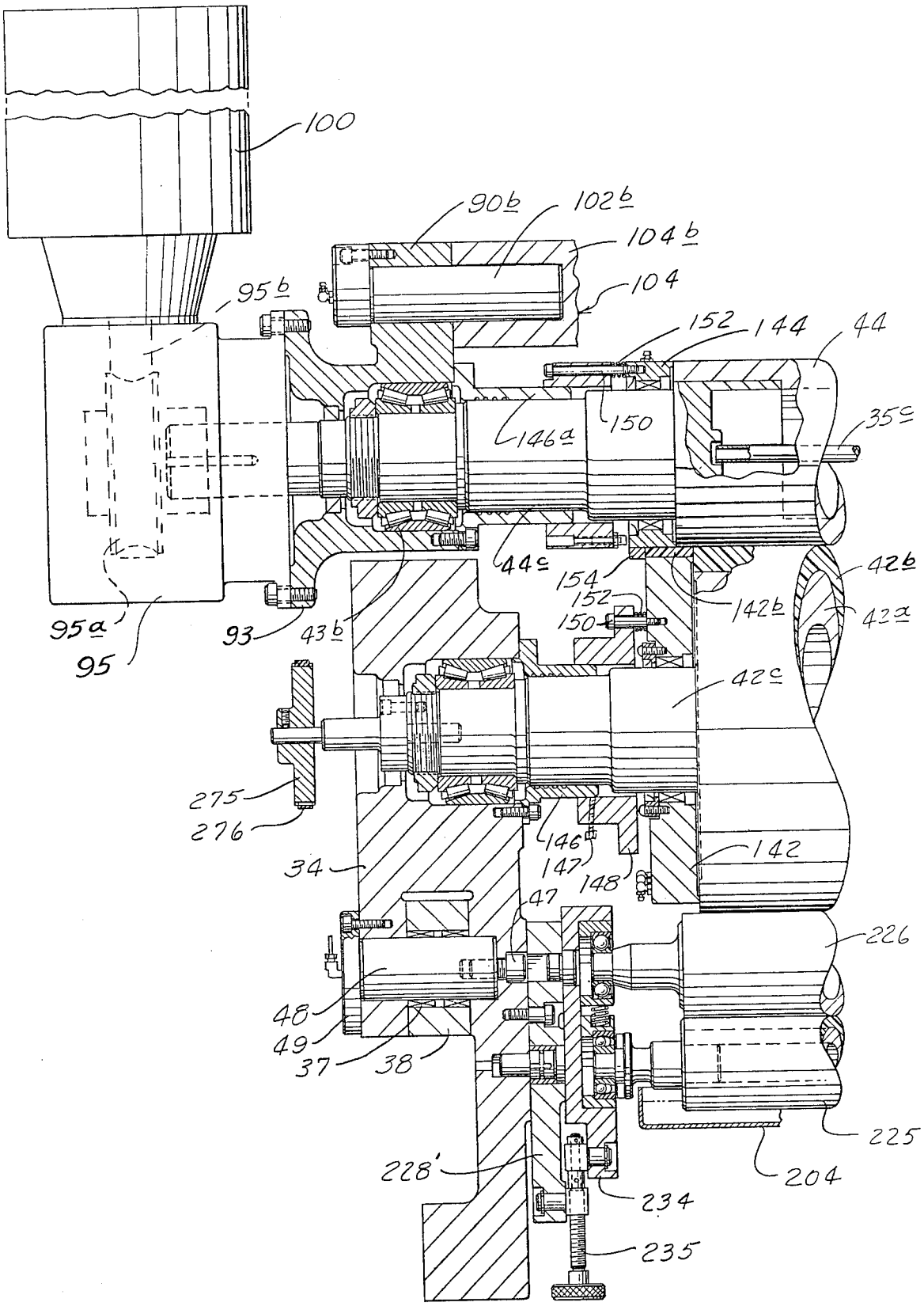
FIG. 6 is a cross-sectional view taken along line 6—6 of FIG. 5.

As best illustrated in FIGS. 3 and 6, opposite ends of applicator roller 42 are rotatably journalled in bearings 43a and 43b secured to side frames 32 and 34, respectively. The inker side frames 32 and 34 are pivotally secured to inker support frames 36 and 38 by pivot pins 47 and 48. Pivot pins 47 and 48 are secured to side frames 32 and 34 by cover plate 49.

Pivot pins 47 and 48 extend through bearing 37 extending through openings formed in the rear portion of support frames 36 and 38.

As best illustrated in FIGS. 4, 7, 8 and 9, means is provided for actuating side frames 32 and 34 relative to support frames 36 and 38 for moving applicator roller 42 into and out of engagement with a printing plate.

Figure 4:
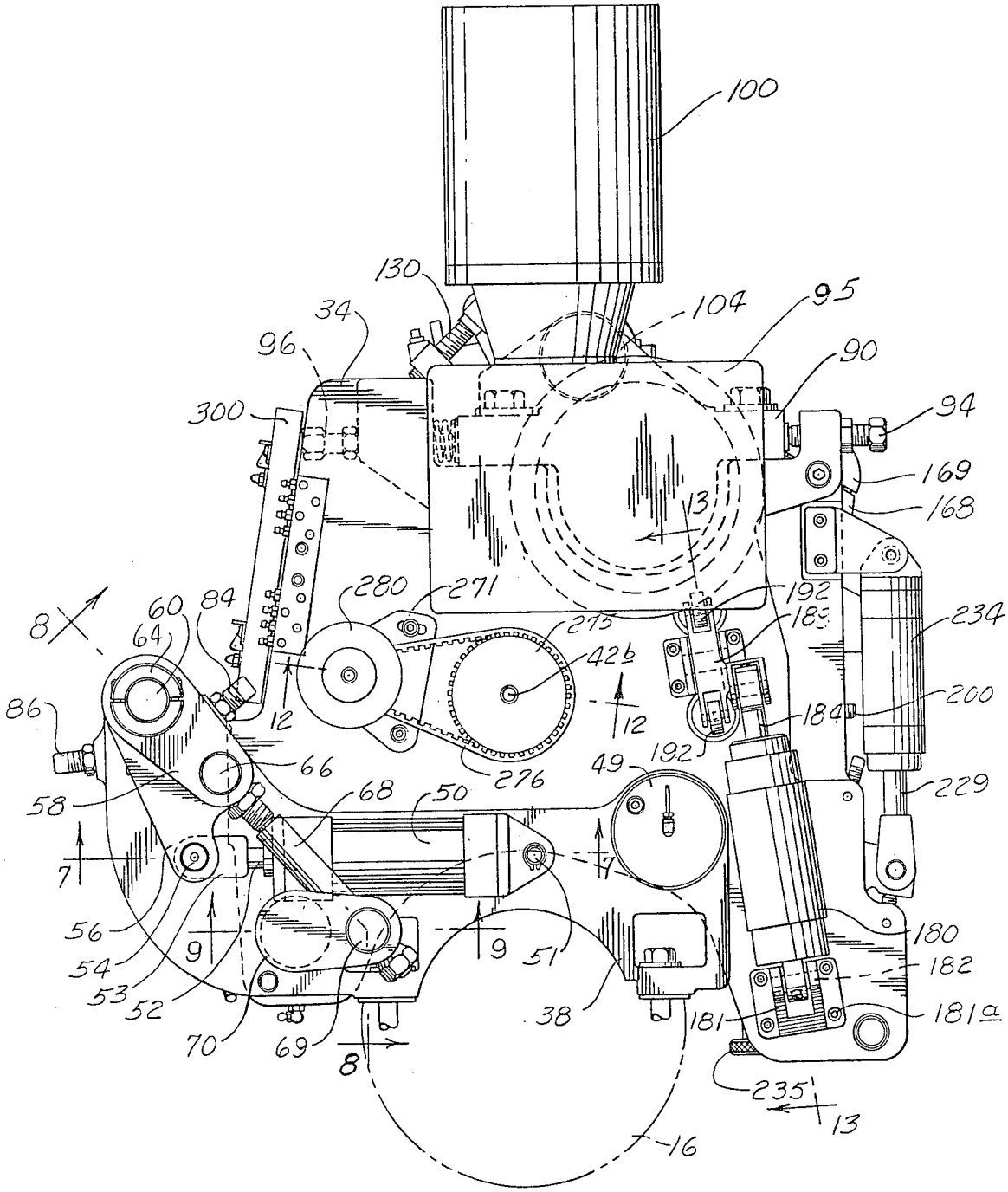
FIG. 4 is a side elevational view of the inking system as viewed from the operator side of a printing press.
Figure 7:
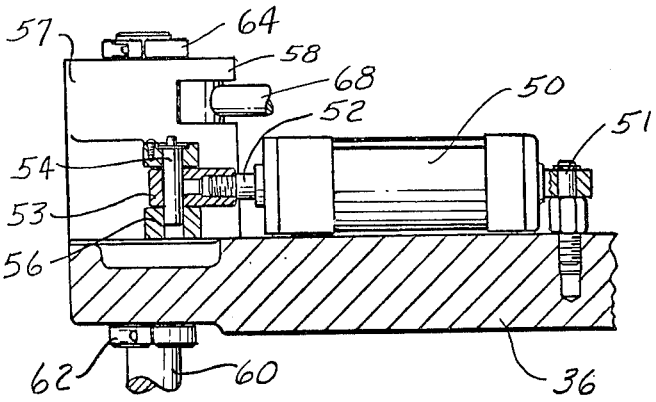
FIG. 7 is a cross-sectional view taken along line 7—7 of FIG. 4.

Referring to FIGS. 4 and 7 of the drawing, inker actuator cylinder 50 has a piston (not shown) slideably disposed therethrough and piston rod 52 is secured to the piston. Cylinder 50 is pivotally secured by a stud 51 to inker support frame 38 on the operator side of the printing press. The piston rod 52 has a clevis 53 secured to the outer end thereof and is pivotally secured by a pin 54 to a downwardly extending crank arm 56 on bell crank 57.

Bell crank 57 has a second crank arm 58 and is secured to an actuator shaft 60 rotatably secured in passages extending through inker support frames 36 and 38. Actuator shaft 60 is restrained against longitudinal movement by retaining collars 62 and 64 grippingly engaging actuator shaft 60 adjacent the inside of each of the support frames 36 and 38 and adjacent the outer surface of each of the bell cranks 57 at each side of the inker.

Crank arm 58 on each of the bell cranks 57 is pivotally secured by a pin 66 to one end of a connecting rod 68. The opposite end of connecting rod 68 is pivotally secured by a pin 69 to a lever 70.

Figure 9:
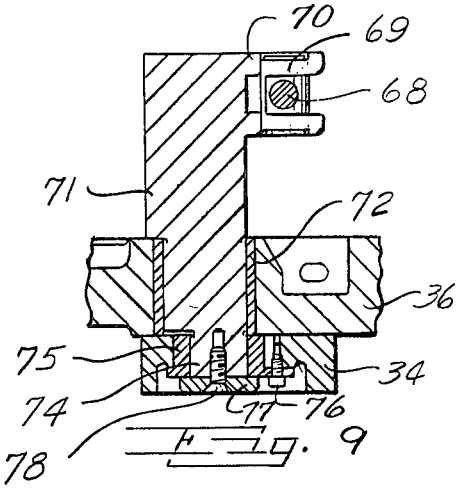
FIG. 9 is a cross sectional view taken along line 9—9 of FIG. 4.

As best illustrated in FIG. 9, lever 70 is secured to a stub shaft 71 which is rotatably disposed in bushings 72 extending through an opening in inker support frame 36. It should be appreciated that, as illustrated in FIG. 1, a lever 70 is secured to a stub shaft 71 extending through the support frame 38 on the operator side of the printing press.

Stub shaft 71 has a journal 74 formed on the outer end thereof which is eccentric to the axis of stub shaft 71. The eccentric journal 74 is rotatably disposed in a hub 75 which is secured to inker side frame 34 by a cap screw 76. The outer end of the eccentric bushings 74 is restrained against longitudinal movement relative to inker side frame 34 by a retainer washer 77 engaging hub 75 and secured to the eccentric journal 74 by a set screw 78.

Figure 2:
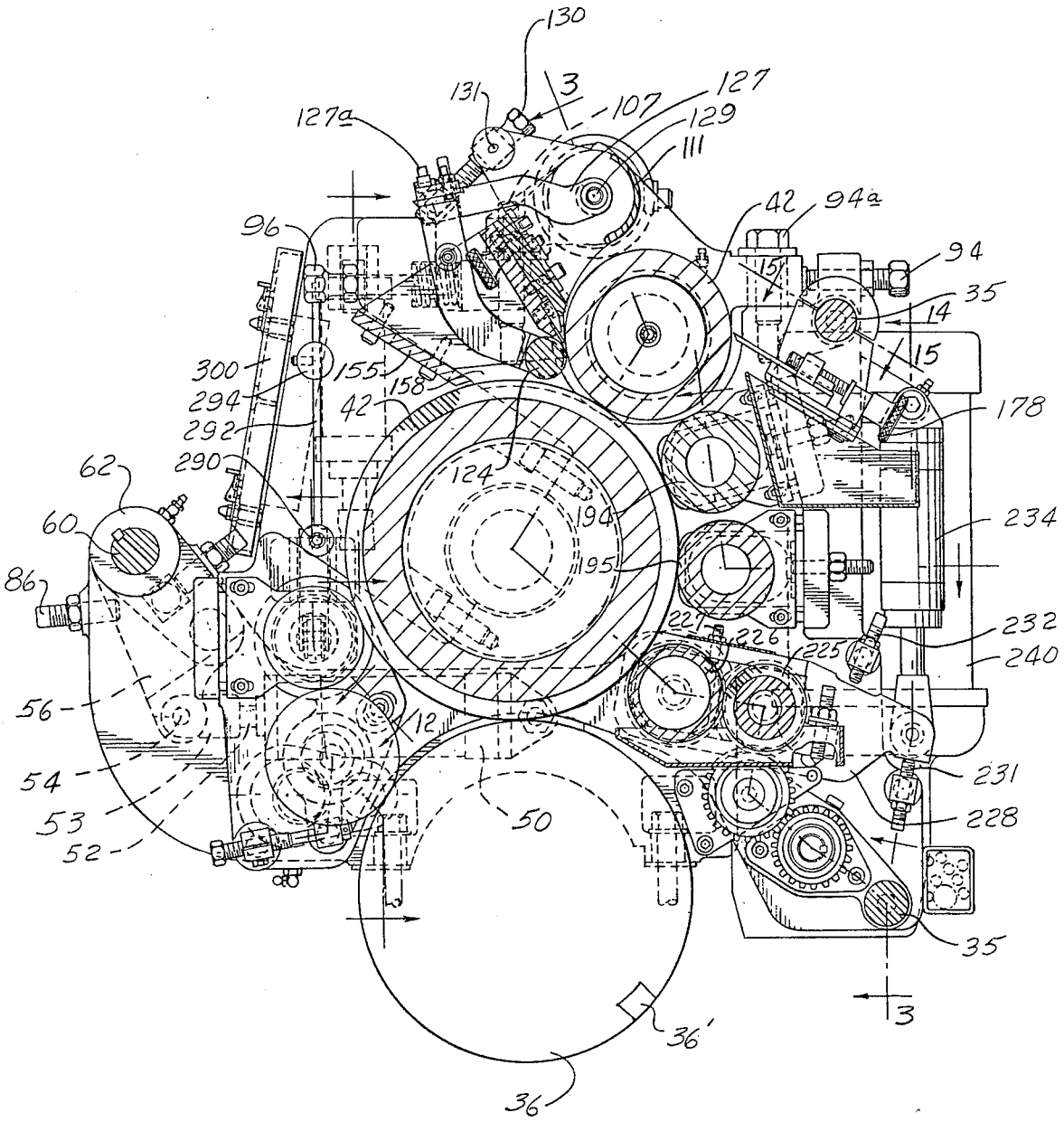
FIG. 2 is a cross-sectional view taken along line 2—2 of FIG. 3 illustrating the inside of the side frame of the drive side of the press.
Figure 8:
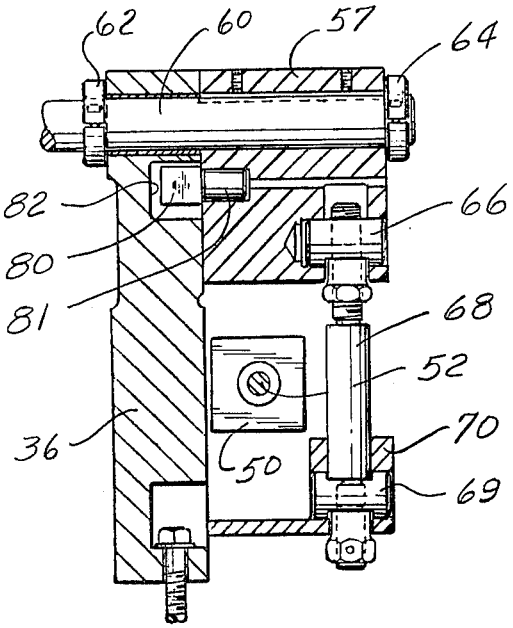
FIG. 8 is a cross-sectional view taken along line 8—8 of FIG. 4.

As best illustrated in FIGS. 2 and 8, an abuttment 80 is secured to bell crank 57 by an anchor pin 81 and is moveable through a slot 82 formed in the outer surface of support frame 36 and in the outer surface of support frame 38. An on-stop adjustment screw 84 is threadedly secured to support frame 36 adjacent one end of slot 82 and an off-stop adjustment screw 86 is threadedly secured to support frame 36 adjacent the opposite end of slot 82.

On-stop adjustment screw 84 is adjusted such that the axis of pin 66, as viewed in FIG. 2, is slightly to the right of a line extending through axes of actuator shaft 60 and pin 69. When the piston rod 52 of actuator cylinder 50 is extended bell crank 57 is rotated such that the axis of pin 66 moves to the left of a line joining the axes of actuator shaft 60 and pin 69, thereby rotating lever 70 and stub shaft 71 in a counter-clockwise direction and transmitting force through eccentric journal 74 to move side frame 32 relative to support frame 36. As side frame 32 moves upwardly the surface of applicator roller 42 is moved out of engagement with the surface of plate cylinder 36. When piston rod 52 is retracted into actuator cylinder 50 to the position illustrated in FIG. 2, the surface of applicator roller 42 is moved into engagement with the surface of plate cylinder 16 and the axis of pin 66 moves to the over toggle position illustrated in FIG. 2.

It should be readily apparent that as the gap 16' in plate cylinder 16 rotates, impact loading will be applied to applicator roller 42. However, applicator roller 42 is restrained against upward movement by on-stop adjustment screw 84.

Pressure between applicator 42 and plate cylinder 16 can be adjusted by rotating on-stop adjustment screw 84.

As best illustrated in FIGS. 1, 2, and 3, the journal 44b extending into the end of metering roller 44 is rotatably supported in bearing 88 disposed in a bore extending through metering roll hanger 90. Metering roll hanger 90 is supported by and is slideably disposed along saddle 92 formed adjacent the upper end of inker side frame 32.

Metering roll stripe adjustment screws 94 and 96 are threadedly secured to side frame 32 in abutting relation with opposite ends of metering roller hanger 90. A spring 98 is positioned about metering roller stripe adjustment screw 96 to resiliently bias metering roller hanger 90 rearwardly toward adjustment screw 94.

Referring to FIG. 2 of the drawing, it should be readily apparent that when adjustment screw 94 is retracted from engagement with metering roller hanger 90, the hanger will be urged to the right as viewed in FIG. 2 moving the surface of metering roller 44 away from the surface of applicator roller 42.

Figure 5:
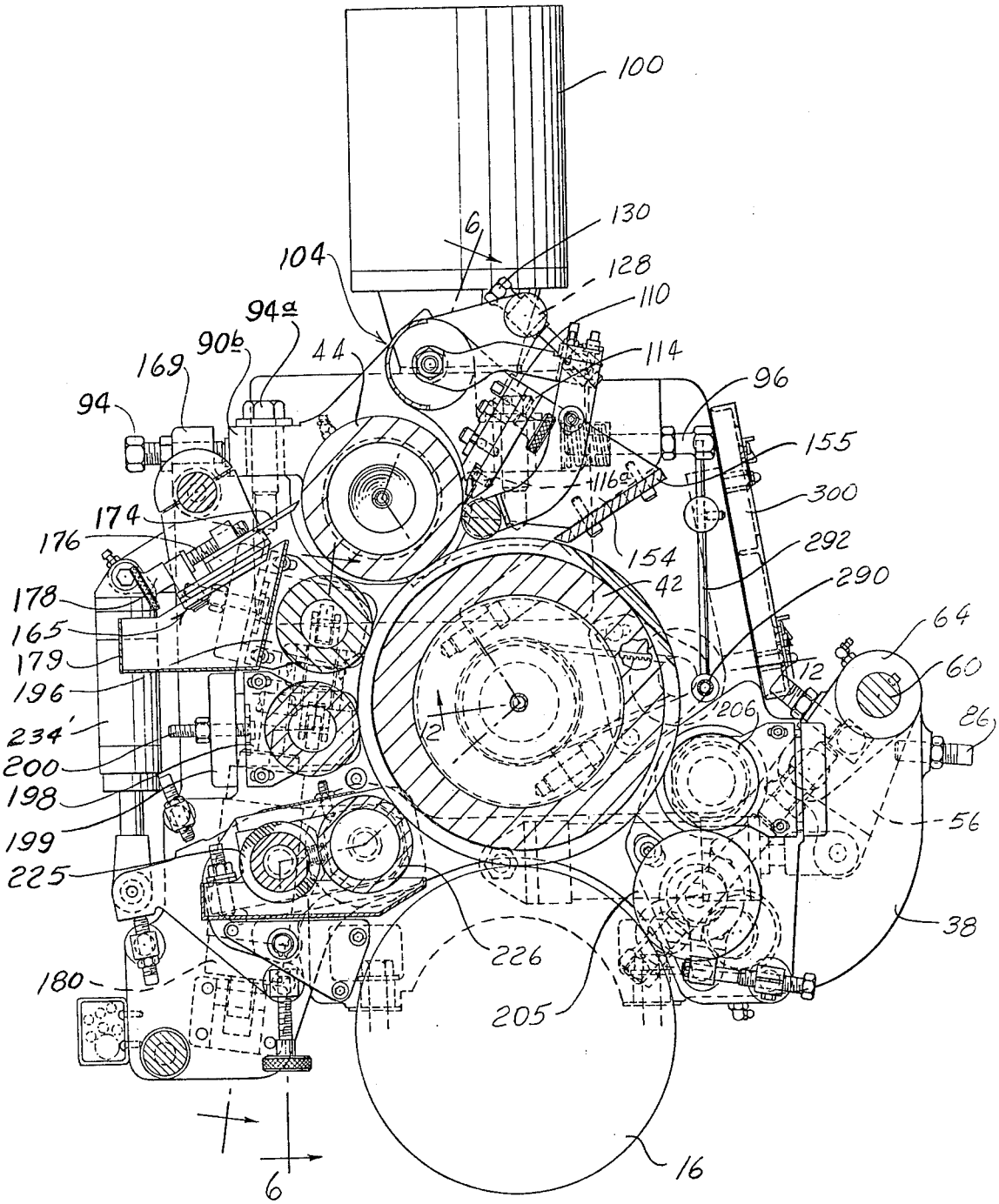
FIG. 5 is a cross-sectional view taken along line 5—5 of FIG. 6 illustrating the inside of the side frame on the operator side of the printing press.

As best illustrated in FIGS. 4, 5, and 6, metering roller hanger **90*b* on the operator side of the printing press is supported by side frame 34. Metering roller hanger 90*b* has a flange 93 formed thereon to which a gear box 95 is secured. The journal 44*c* on metering roller 44 is rotatably supported in bearing 43*b* and has a double enveloping worm gear 95*a*** secured to the end thereof.

The variable speed metering roller drive motor 100 is supported by gear box 95 and has a drive shaft drivingly connected to a worm **95*b* positioned in meshing relation with worm gear 95*a***.

Metering roller hangers 90 and **90*b* have elongated slots formed therein through which hanger bolts 94*a* and 96*a* extend into threaded passages formed in side frames 32 and 34 for securing hangers 90 and 90*b* after metering roller 44 has been moved into pressure indented relation with the surface of applicator roller 42**.

As best illustrated in FIGS. 1, 2, and 3 metering roller hangers 90 and **90*b* having an upwardly extending ear having an aperture extending therethrough in which stub shafts 102 and 102*b* are rotatably disposed. Stub shafts 102 and 102*b* extend into bores formed in opposite ends of doctor blade support 104**.

Doctor blade support 104 comprises a casting having end sections **104*a* and 104*b* pivotally secured to stub shafts 102 and 102*b*. As illustrated in FIG. 2 the end section 104*a* of doctor blade holder 104 has a forwardly extending anchor lug 106 detachably secured to metering roller hanger 90 by a cap screw 107**.

A doctor blade mounting plate 110 extends transversely between forwardly extending arms 108 on end sections **104*a* and 104*b* of doctor blade holder 104. A reinforcing web 111 has opposite ends secured to arms 108 and is disposed in spaced apart relation from doctor blade mounting plate 110 to form a strong rigid blade holder structure. If it is deemed expedient to do so, reinforcing brace arms may be mounted between doctor blade mounting plate 110 and reinforcing web 111 at spaced locations intermediate opposite ends of the doctor blade holder 104**.

Each of the doctor blade holder end sections **104*a* and 104*b* have upwardly extending lever arms 112** as will be hereinafter more fully explained.

Figure 20:
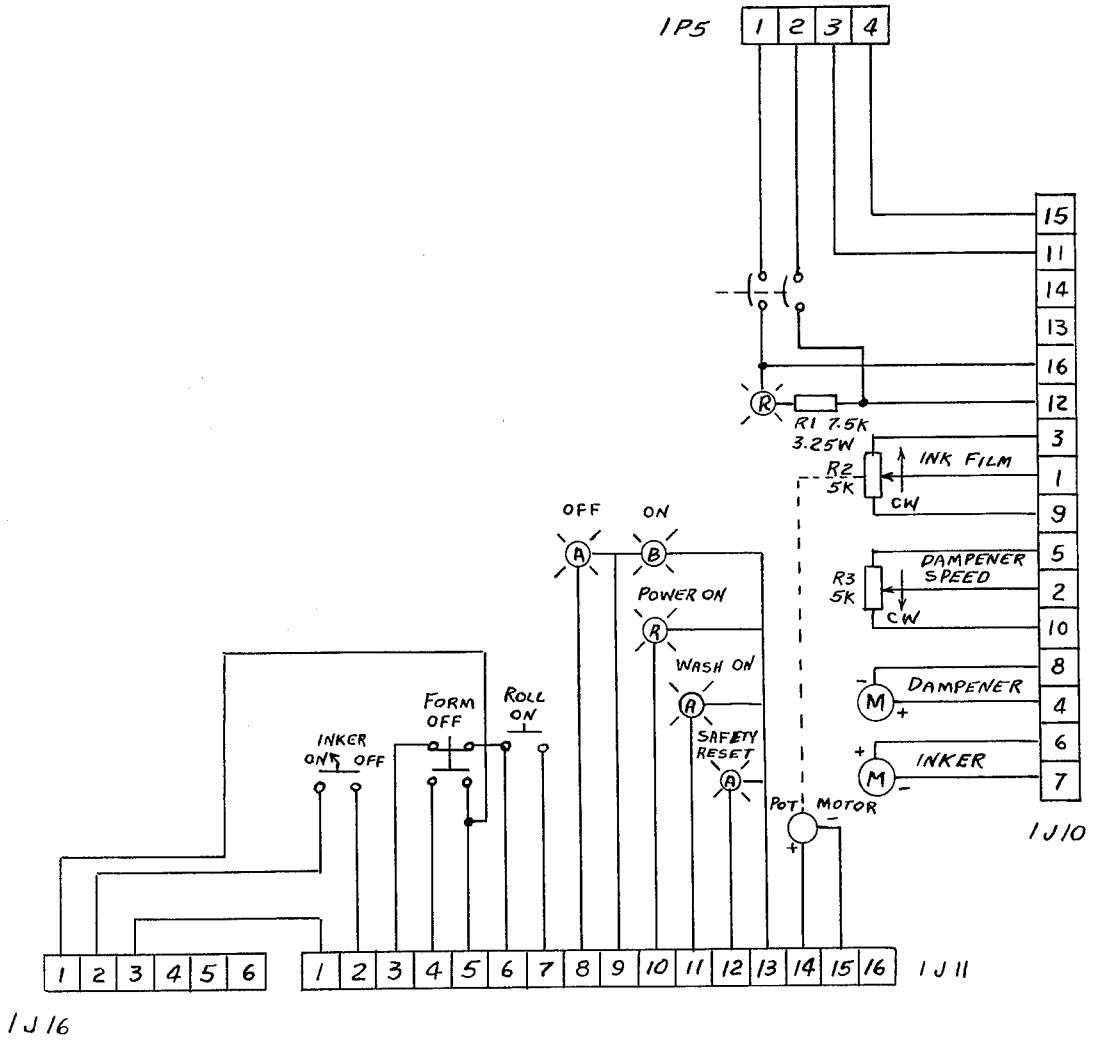
FIG. 20 is a wiring diagram of a remote unit control panel.

A doctor blade support plate 114 is adjustably secured to doctor blade mounting plate 110 by doctor blade adjustment eccentric cams 116, as best illustrated in FIG. 20. Doctor blade adjustment eccentric cams have a cam element **116*a* extending into bore 114*a* in doctor blade support plate 114. The cam element is supported by a screw element extending through a threaded passage in doctor blade mounting plate 110**.

A doctor blade 118 is secured to the lower edge of doctor blade support plate 114 by a blade clamp bar 120 detachably secured to doctor blade support plate 114 by a set screw 121. Doctor blade 118 is a thin, flexible razor blade having an extremely sharp wedge shaped edge.

A locking screw 122 extends through a slotted opening in doctor blade support plate 114 and is threadedly secured to doctor blade mounting plate 110. Locking screw 122 is loosened prior to adjustment of doctor blade support plate 114 and is tightened to secure doctor blade support plate 114 relative to doctor blade mounting plate 110 after the blade has been adjusted to the desired pressure relative to metering roller 44.

A nip roller 124 is positioned adjacent surfaces of applicator roller 42 and metering roller 44 and has opposite ends rotatably secured in nip roller hanger elements 126.

Nip roller hanger elements 126 are adjustably secured to support arm 128 which is pivotally secured to doctor blade support 104 by mounting bolts 129. A nip roller adjustment screw 130 extends through mounting block 131 which is pivotally secured to the upper end of lever arm 112 supported by doctor blade holder 104. Nip roller adjustment screw 130 extends through a threaded passage in mounting block 132 pivotally secured to support arm 128.

The outer end of support arm 128 has a downwardly extending lug **128*a* and a horizontally extending shoulder 128*b* mounted thereon. Nip roller hanger element 126 has a slotted passage formed therein through which a locking screw 127 extends. Adjustment screws 127*a* extend through shoulder 128*b* and into the upper edge of nip roller hanger 126**.

From the foregoing it should be readily apparent that nip roller 124 may be adjusted relative to the surfaces of applicator roller 42 and metering roller 44 by rotating nip roller adjustment screw 130 for pivotting support arm 128 about mounting bolt 129. Rotation of adjustment screw 130 moves nip roller 124 arcuately about mounting bolt 129. Rotation of screws **127*a* moves nip roller hanger 126 relative to support arm 128**.

Referring to FIG. 6 of the drawing a stationary end dam disc 142 is rotatably secured to applicator roller 42 by a bearing **142*a*. A stationary end dam disc 144 is rotatably secured to the end of metering roller 44 by a bearing 144*a***.

End dam disc 144 is preferably constructed of the same material as metering roller 44 and has an outside diameter which is equal to the diameter of metering roller 44. End dam disc 142, secured to the end of applicator roller 42, preferably has a diameter which is less than the outside diameter of applicator roller 42 and has a resilient cover **142*b* constructed of a material having the same resilient characteristics as that of the cover 42*b* on applicator roller 42. The distance from the central axis of applicator roller 42 to the surface of resilient cover 42*b* is the same as the distance from the central axis to the surface of resilient cover 142*b* on end dam disc 142**.

Upon referring to FIG. 6 of the drawing, it should be noted that metering roller 44 is slightly longer than applicator roller 42 such that contacting surfaces between the end of applicator roller 42 and end dam disc 142 is not in alignment with contacting surfaces between metering roller 44 and end dam disc 144.

A hub 146 is positioned about the axle **42*c* on the end of applicator roller 42 and is secured by a cap screw 147 to inker side frame 34. An end dam disc anchor sleeve 148 is slideably disposed about hub 146 and is adjustably secured in position by set screw 147. Anchor sleeve 148 preferably has at least three passages formed therein through which screws 150 extend. Screws 150 are threadedly secured in threaded passages formed in circumferentially spaced apart relation in end dam disc 142. Springs 152** are positioned between anchor sleeve 148 and end dam disc 142 for urging end dam disc 142 into sealing engagement with the end of applicator roller 42.

It should be readily apparent that end dam disc 142 is resiliently urged by springs 152 into sealing engagement with the end of applicator roller 42 and is restrained against rotation by hub 146 and anchor sleeve 148.

A hub 146*a* is disposed about the end of metering roller 44 and is secured by cap screw 147*a* to metering roller hanger 90. An anchor sleeve 148*a* is slideably secured to hub 146*a* and has screws 150 extending therethrough which engage end dam disc 144 which is resiliently urged into sealing engagement with the end of applicator roller 44 by springs 152.

An end dam 154 is secured to doctor blade holder 104 by screws 156, as illustrated in FIG. 5, and has an arcuate sealing surface 158 urged into sealing relation with the periphery of end dam disc 144 on the end of metering roller 44. End dam 154 has a planar sealing surface 160 urged into sealing relation with the planar end surface of end dam disc 142 on the end of applicator roller 42.

From the foregoing it should be readily apparent that the provision of end dam discs 142 and 144 which are stationary and urged into sealing relation with ends of applicator roller 42 and metering roller 44, in the manner hereinbefore described, permits the formation of a seal by end dam 154 with non-rotating surfaces. It should further be apparent that arcuate sealing surface 158 is urged into sealing relation with the periphery of disc 144 while planar sealing surface 160 is urged into sealing engagement with the end of disc 142. This permits adjustment of pressure between rollers 42 and 44 without disturbing the effectiveness of the sealing capability of end dam 154. It should further be noted that the particular end dam construction reduces precise manufacturing requirements which have been required heretofore for sealing between rollers arranged in pressure indented relation wherein ink was maintained in a nip between the rollers.

Each of the end dam discs 142 and 144 has a lubricant chamber 145 formed in the face thereof which communicates with a lubricant passage 145*a* having a grease fitting 145*b* extending thereinto. Grease can be urged under pressure into chamber 145 to provide lubrication between the rotating end surface of rollers 42 and 44 and the stationary discs 142 and 144. The pressurized lubricant also inhibits flow of ink into the connection between ends of the rollers and the stationary end dam discs.

An ink retainer member 155 is positioned in sealing relation with the surface of applicator roller 42 and has opposite ends secured to end dams 154 by screws 155*a*.

Ink is deposited in a reservoir defined by surfaces of applicator roller 42 and metering roller 44, between the spaced end dams 154, and bounded on opposite sides by doctor blade holder 104 and ink retainer member 155.

Figure 15:
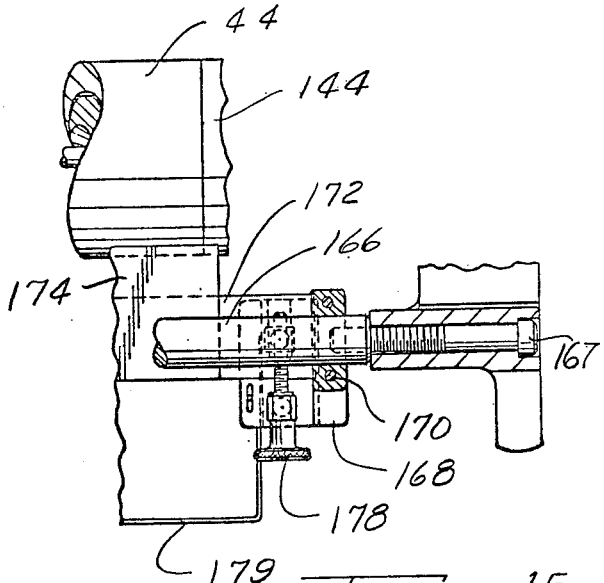
FIG. 15 is a cross-sectional view taken along line 15—15 of FIG. 2.

As best illustrated in FIGS. 5 and 15 a wash-up doctor blade holder 165 extends between inker side frames 32 and 34 and is positionable in engagement with surfaces of metering roller 44.

A support shaft 166 is secured between side frames 32 and 34 by screws 167 extending through the side frames and into opposite ends of support shaft 166. A wash-up blade holder comprises mounting arms 168 secured to support shaft 166 by split blocks 169 and bolts 170. A mounting plate 172 extends between and has opposite ends secured to mounting arms 68. A doctor blade 174 is secured to slide member 176 adjustably secured to mounting plate 172 by a screw 178.

For removing ink from reservoir R, cap screw 107 is removed from anchor lug 106 permitting rotation of doctor blade support 104 to a position wherein doctor blade 118 is spaced from the surface of metering roller 44. Screw 178 is rotated to a position wherein doctor blade 174 is positioned in engagement with the surface of metering roller 44. Metering roller drive motor 100 is then engaged causing rotation of metering roller 44 in a counter-clockwise direction is viewed in FIG. 5 thereby moving ink on a surface of metering roller 44 toward doctor blade 174. Doctor blade 174 scrapes the ink from the surface of metering roller 44 and causes the ink to be deposited in pan 179 suspended from mounting plate 172.

Figure 13:
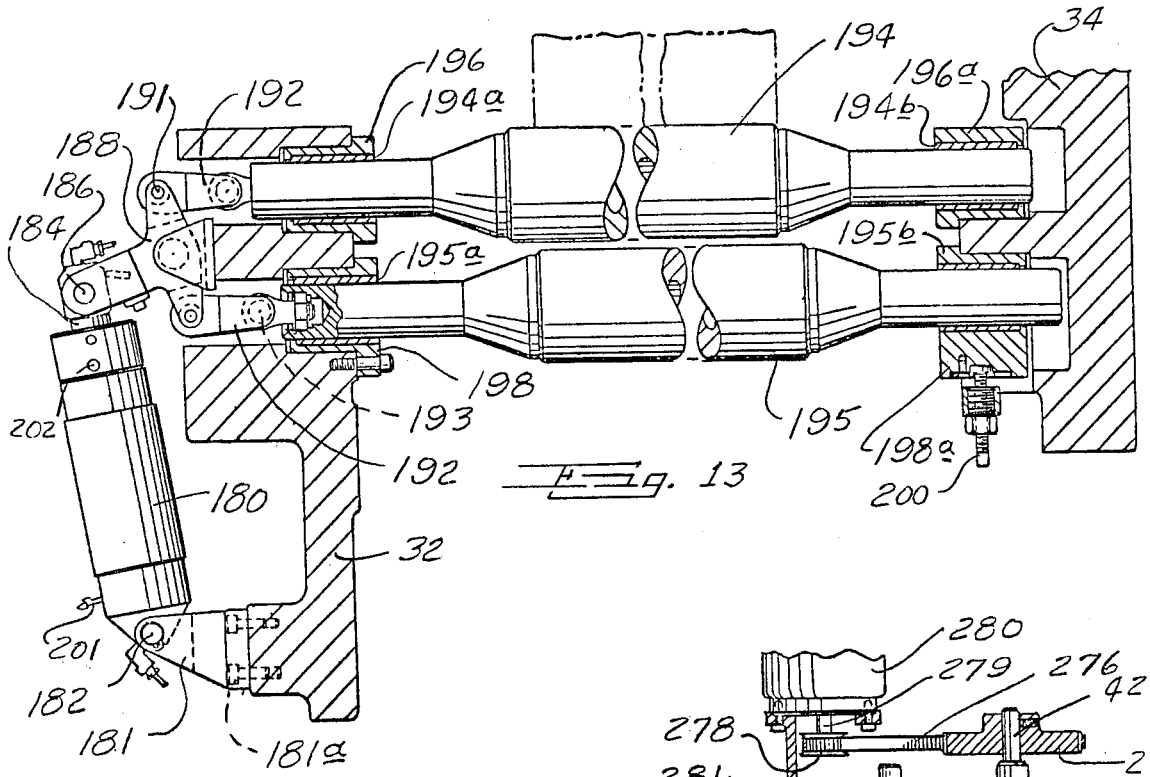
FIG. 13 is a cross-sectional view taken along line 13—13 of FIG. 4.
Figure 12:
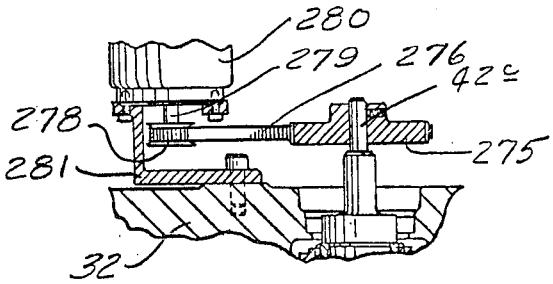
FIG. 12 is a cross-sectional view taken along line 12—12 of FIG. 4.

As best illustrated in FIGS. 4 and 13 of the drawing, the operator side side frame has a vibrator actuator cylinder 180 pivotally secured thereto by an anchor bracket 181 secured to side frame 32 by bolts 181*a*. The cylinder is secured to bracket 181 by a pin 182 and has a piston (not shown) slidably disposed therein to which piston rod 184 is secured. Piston rod 184 is pivotally secured by a pin 186 to a rocker arm 188 pivotally secured by a pin 190 to side frame 32. Rocker arm 188 has lugs extending outwardly from opposite sides thereof, each of said lugs being connected by a pin 199 to a connector rod 192. Connector rods 192 are pivotally connected by pins 193 to vibrator rollers 194 and 195.

Vibrator rollers 194 and 195 have ends slidably disposed in bushings 194*a* and 195*a* which extend through slide blocks 196*a* and 198 adjustably secured to the operator side side frame 32 as illustrated in FIG. 5. Each of the slide blocks 196 and 198 has a slotted passage formed therein for securing the slide block to the side frame. A lug 199 is positioned adjacent each of the slide blocks 196 and 198 and has a pressure adjustment screw 200 threadedly secured therein having an end in engagement with slide blocks 196 and 198 permitting adjustment of vibrator rollers 194 and 195 into pressure indented relation with the surface of applicator roller 42. Slide blocks 196*a* and 198*a* are similarly adjustably secured to the drive side side frame 34.

Fluid supply lines 201 and 202 communicate with opposite ends of cylinder 180 to alternately deliver pressurized fluid to opposite ends thereof to impart reciprocating motion to piston rod 184 which in turn reciprocates vibrating rollers 194 and 195 in opposite directions longitudinally of the rollers.

Figure 10:
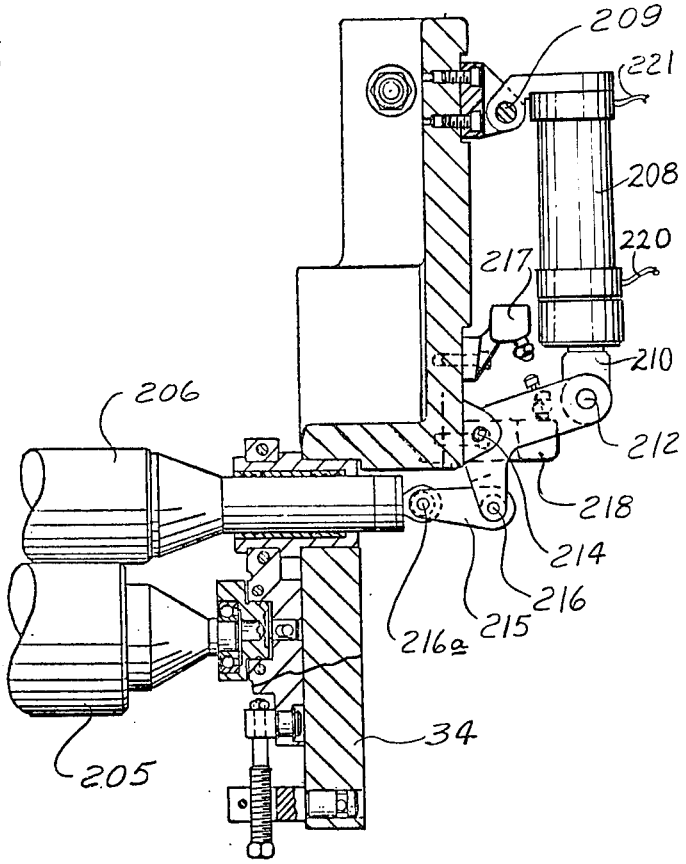
FIG. 10 is a cross-sectional view taken along line 10—10 of FIG. 1.
Figure 11:
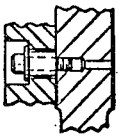
FIG. 11 is a cross-sectional view taken along line 11—11 of FIG. 2.

As best illustrated in FIGS. 5 and 10, a secondary form roller 205 is positioned in rolling engagement with the surface of the printing plate on plate cylinder 16 and a secondary vibrator roller 206 is positioned in pressure indented relation with applicator roller 42 and with secondary form roller 205. Opposite ends of the secondary vibrator roller 206 are rotatably mounted in slide blocks 207 which are adjustably secured to side frames 32 and 34 of the inker.

A double acting pressure actuated cylinder 208 is pivotally secured by a pin 209 to the operator side side frame 34 and has a piston (not shown) slideably disposed therein.

A piston rod 210 is connected to the piston and has an outer end pivotally secured by a pin 212 to a bell crank 213 which is pivotally connected to side frame 34 by a pin 214. A connecting rod 215 has opposite ends pivotally secured by pins 216 and 216*a* to bell crank 213 and to the end of secondary vibrator roller 206. Micro switches 217 and 218 are positioned to be alternately engaged by bell cranks 213 for energizing of solenoid actuated valve to alternately deliver pressurized fluid to supply lines 220 and 221 communicating with opposite ends of cylinder 208.

Referring to FIGS. 3, 5, and 6 of the drawing means is provided for applying dampening fluid to a metered film of ink on the surface of applicator roller 42.

In the particular embodiment of the invention illustrated in the drawing dampening fluid from a pan 204 is delivered over a resilient covered dampening fluid metering roller 225 to a dampening fluid applicator roller 226 having a hard hydrophilic surface. Dampening fluid metering roller 225 and dampening fluid applicator roller 226 are disposed in pressure indented relation.

Figure 14:
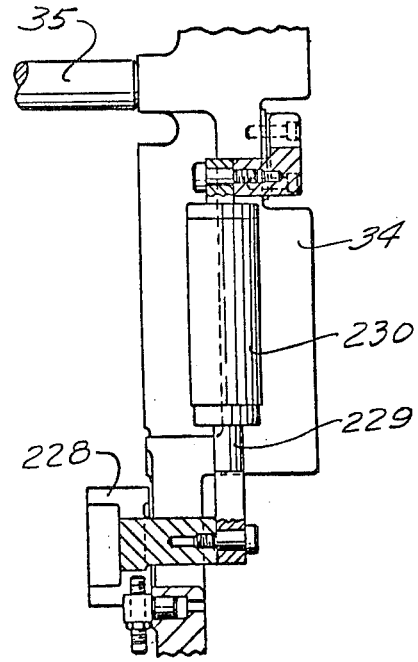
FIG. 14 is a cross-sectional view taken along line 14—14 of FIG. 2.

As best illustrated in FIG. 3, hydrophilic roller 226 and metering roller 225 have ends rotatably secured to a hanger 228 pivotally secured by a pin 230 to inker side frame 32 on the drive side of the printing press. As illustrated in FIGS. 2 and 14, hanger 228 is secured to rod 229 of dampener throw-off cylinder 230. Hanger 228 engages an on-stop 231 when piston rod 229 is extended and the surface of hydrophilic roller 226 is urged into pressure indented relation with the surface of applicator roller 42. When piston rod 229 is retracted hanger 228 moves into engagement with off-stop 232 and hydrophilic roller 226 is moved out of pressure indented relation with applicator roller 42.

As illustrated in FIG. 6, opposite ends of dampening fluid metering roller 225 and dampening fluid applicator roller 226 are rotatably journalled in a skew arm 234 which is pivotally connected by pin 236 to hanger 228'. Hanger 228' is pivotally secured by pin 230' to side frame 34. A cylinder 234', is connected in the same manner as cylinder 234 for actuating hanger 228'.

A skew adjustment screw 235 is pivotally connected between hanger 228' and skew arm 234 for rotating one end of dampening fluid metering roller 225 circumferentially about the axis of metering roller 226 for adjusting pressure intermediate opposite ends of the rollers without changing pressure adjacent ends thereof.

Rollers 225 and 226 are mounted in bearings 225' and 226' such that pressure between adjacent surfaces of metering roller 225 and applicator roller 226 can be adjusted by rotating pressure adjustment screw 227.

As best illustrated in FIG. 3 a variable speed dampener drive motor 240 is mounted on a support 242 which is secured to side frame 32 on the drive side of the printing press. Motor 240 is drivingly connected through a gear reducer 243, clutch 244, gear 245, and gear 246 to a gear 247 rigidly secured to dampening fluid metering roller 225. Gear 227 is in meshing relation with gear 228 secured to dampening fluid applicator roller 226.

As best illustrated in FIGS. 1 and 3, the shaft 42c on the end of applicator roller 42 has a clutch 250 secured thereto which is secured by cap screws 251 to a sprocket 252.

As illustrated in FIG. 1, the axle 16c on the end of plate cylinder 16 has a spider bracket 254 mounted thereon. The spider bracket 254 is rigidly secured to the inker support frame 36 on the drive side of the printing press. Thus, spider support frame 254 does not rotate.

A sprocket 256 is secured to an rotates with plate cylinder axle 16c. Spider mounting bracket 254 has idler sprockets 258 and 260 mounted thereon, sprocket 260 being mounted in a slide 262 for adjustment longitudinally of bracket mounting arm 264 upon rotation of screw 268. A chain 270 extends about sprocket 252, sprocket 256, and idler sprockets 258 and 260.

If sprockets 252 and 256 are of equal size, the surface of plate cylinder 16 and the surface of ink applicator roller 42 will move at equal surface speeds. However, if one of the sprockets is slightly larger than the other sprocket, the surface of applicator roller 42 will move at a surface speed which is different from that of the surface speed of plate cylinder 16.

Plate cylinder axle 16c is driven in conventional manner by a drive motor (not shown).

If it is deemed expedient to do so, applicator roller 42 may be driven by a separate drive motor (not shown) thereby reducing force transmitted through chain 270. In such instance, chain 270 would serve as a timing belt to maintain a predetermined surface speed relationship between ink applicator roller 42 and printing plate 16.

As best illustrated in FIGS. 4 and 6, the opposite end 42c of ink applicator roller 42 has a timing sprocket 275 rigidly secured thereto about which a timing belt 276 extends. As illustrated in FIG. 15, timing belt 276 extends about pulley 278 on the drive shaft 279 of tachometer generator 280. The tachometer generator is secured to a mounting bracket 281 secured to the side frame 32 of the inker.

As illustrated in FIG. 2, a hollow tube 290 having spaced openings formed therein is supported by a support arm 292 which is pivotally secured by a support pin 294 to the inker side frames. A source of pressurized air, or other suitable fluid is connected to the end of tube 290 such that pressurized air is directed to impinge against the surface of applicator roller 42 for evaporating any excess dampening fluid which remains thereon after the surface of applicator roller 42 moves out of engagement with plate cylinder 36 to prevent accumulation of excessive quantities of dampening fluid in ink reservoir R.

As illustrated in FIG. 4 of the drawing an electrical system control panel 300 is mounted on inker side frame 32 on the operator side of the printing press.

Figure 19:
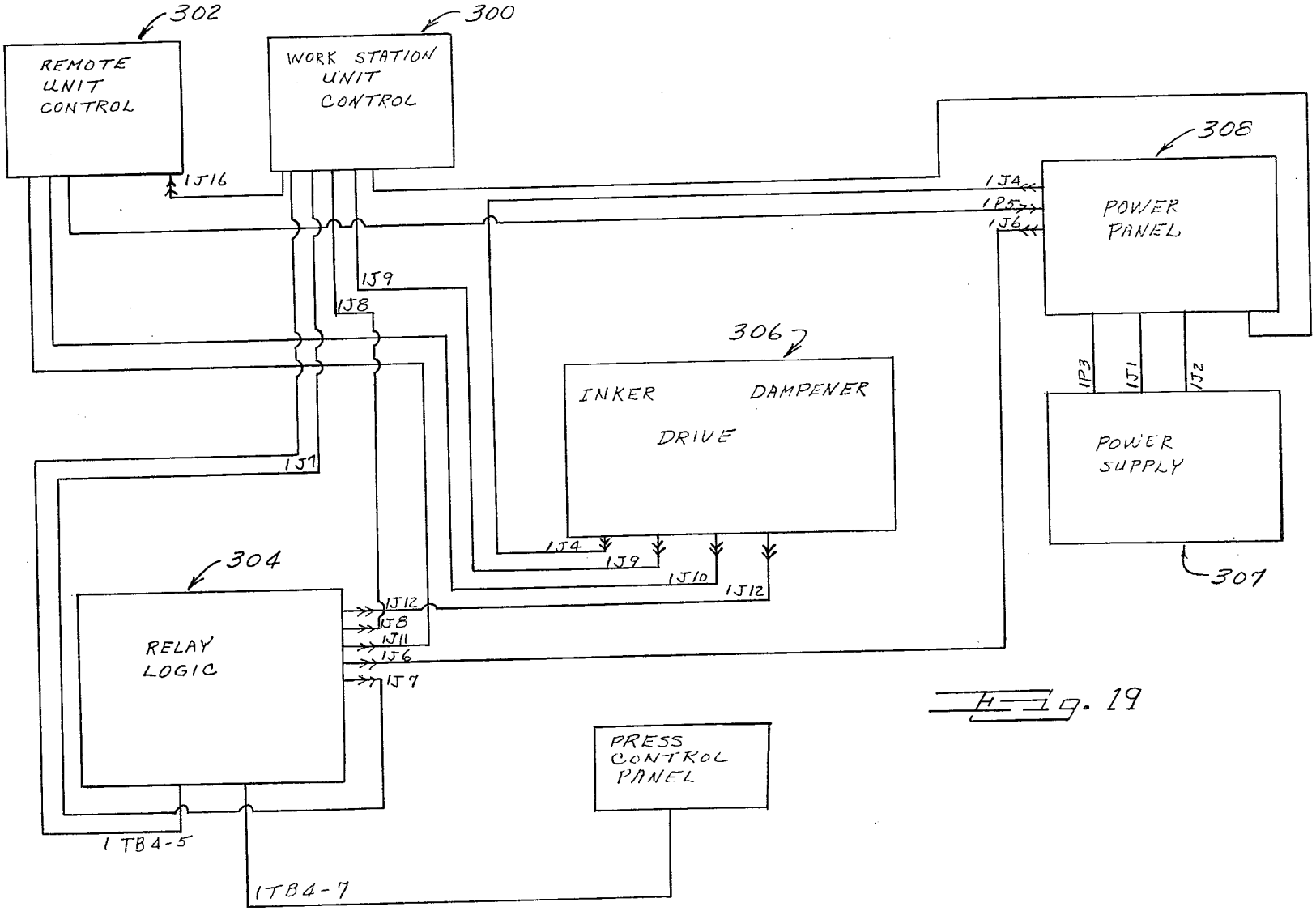
FIG. 19 is a block diagram of the inker control system.

A block diagram of the electrical control system is illustrated in FIG. 19. Two control panels 300 and 302 are provided for controlling the inking and dampening systems at each printing station. A work station control unit 300 is mounted adjacent each work station. A remote unit control station 302 is positioned at a console, preferably adjacent the delivery end of the printing press.

Control units 300 and 302 are connected to a relay logic panel 304 which is connected to a power panel 308 and to inker and dampener drive circuits 306. Power panel 308 is connected to a source 307 of electricity.

Figure 21:
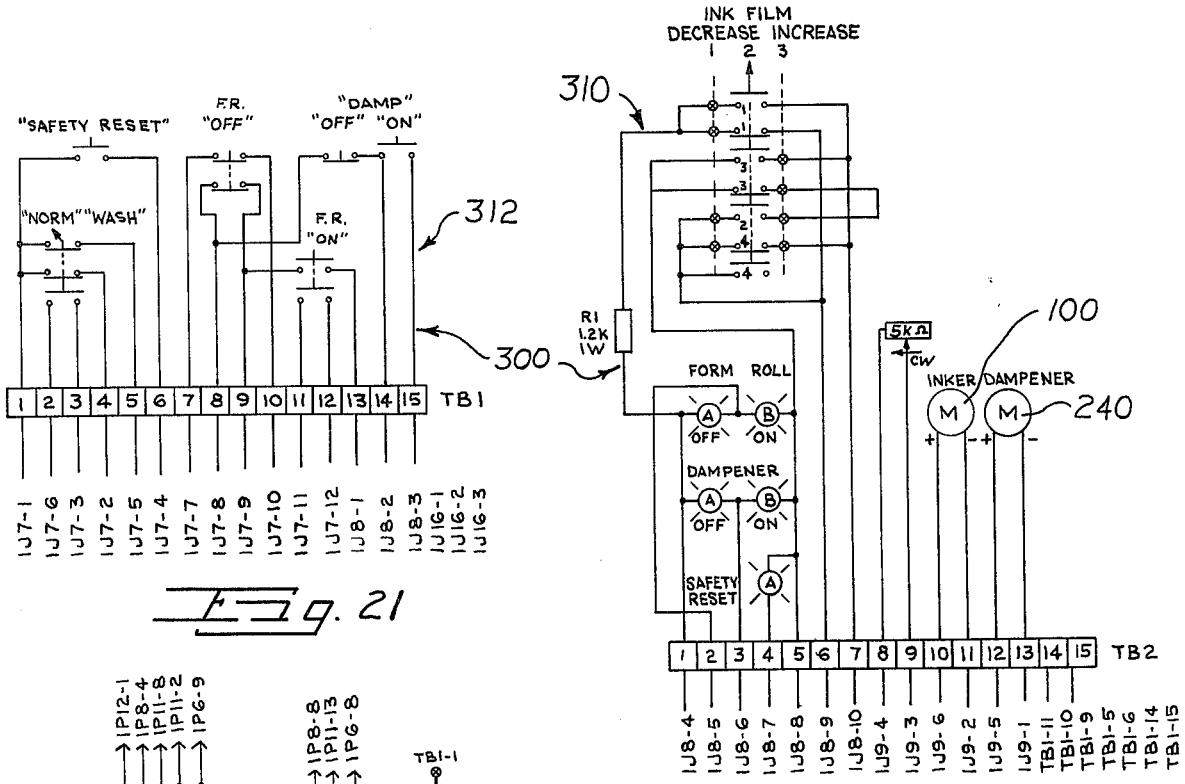
FIG. 21 is a wiring diagram of a work station unit control panel.

Referring to FIG. 21 of the drawing, unit control 300 comprises an ink film control circuit 310 and a dampening fluid control circuit 312. As will be hereinafter more fully explained, the speed of variable speed motor 100 driving metering roller 44 is controlled by a variable resistor 311.

Figure 18:
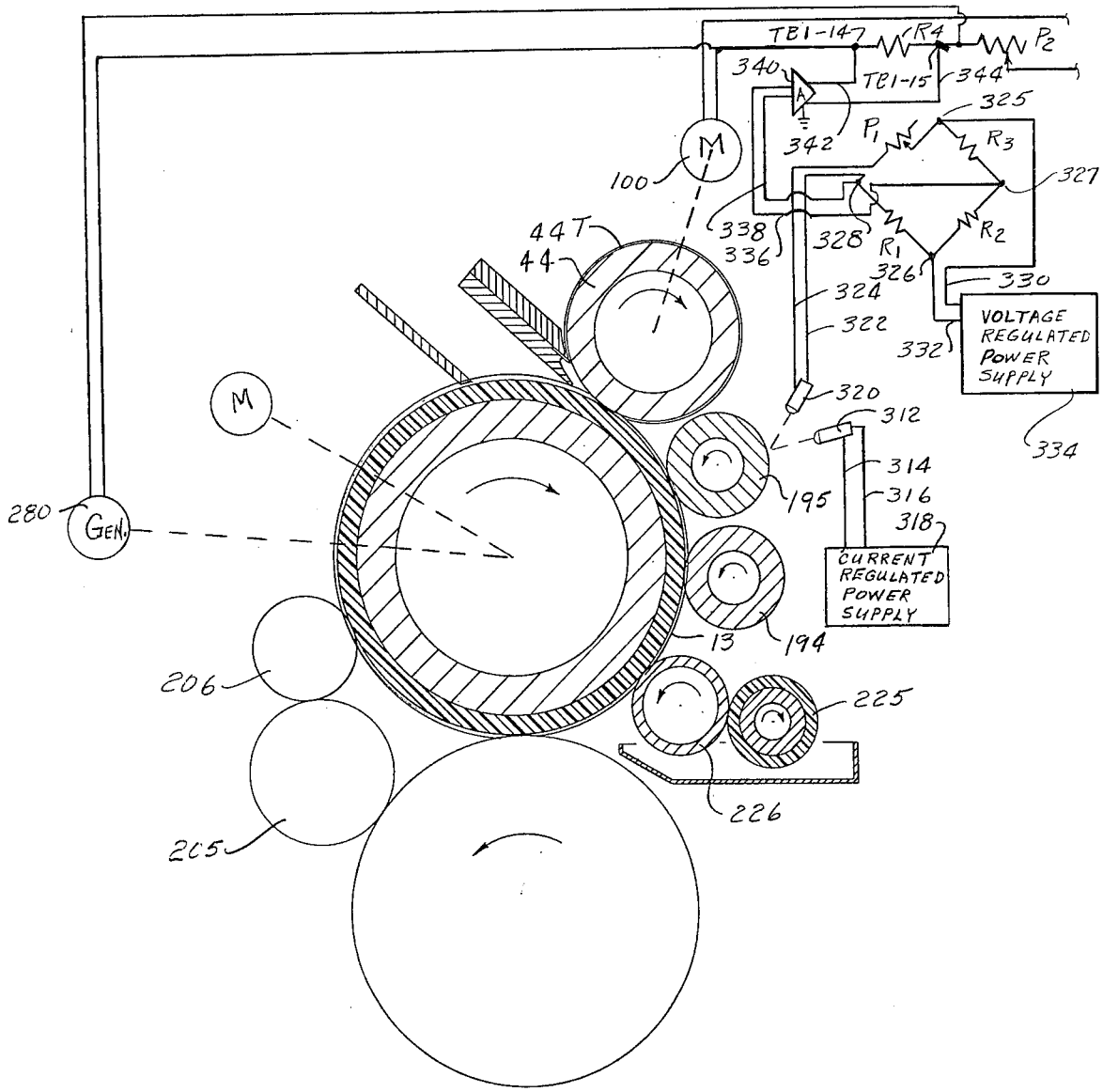
FIG. 18 is a diagrammatic view of apparatus to control ink film thickness.
Figure 23A:
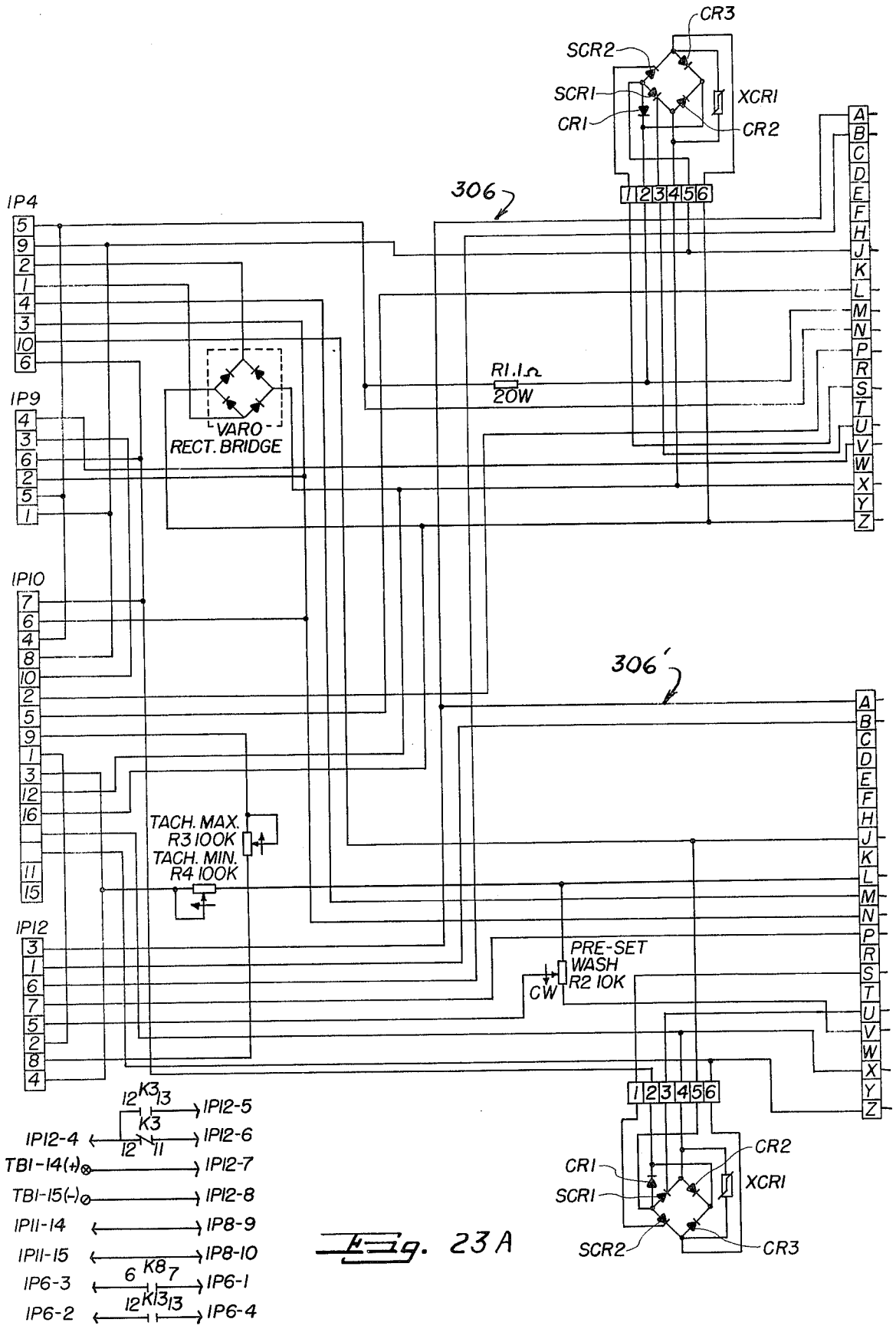
Figures 1, 23B:
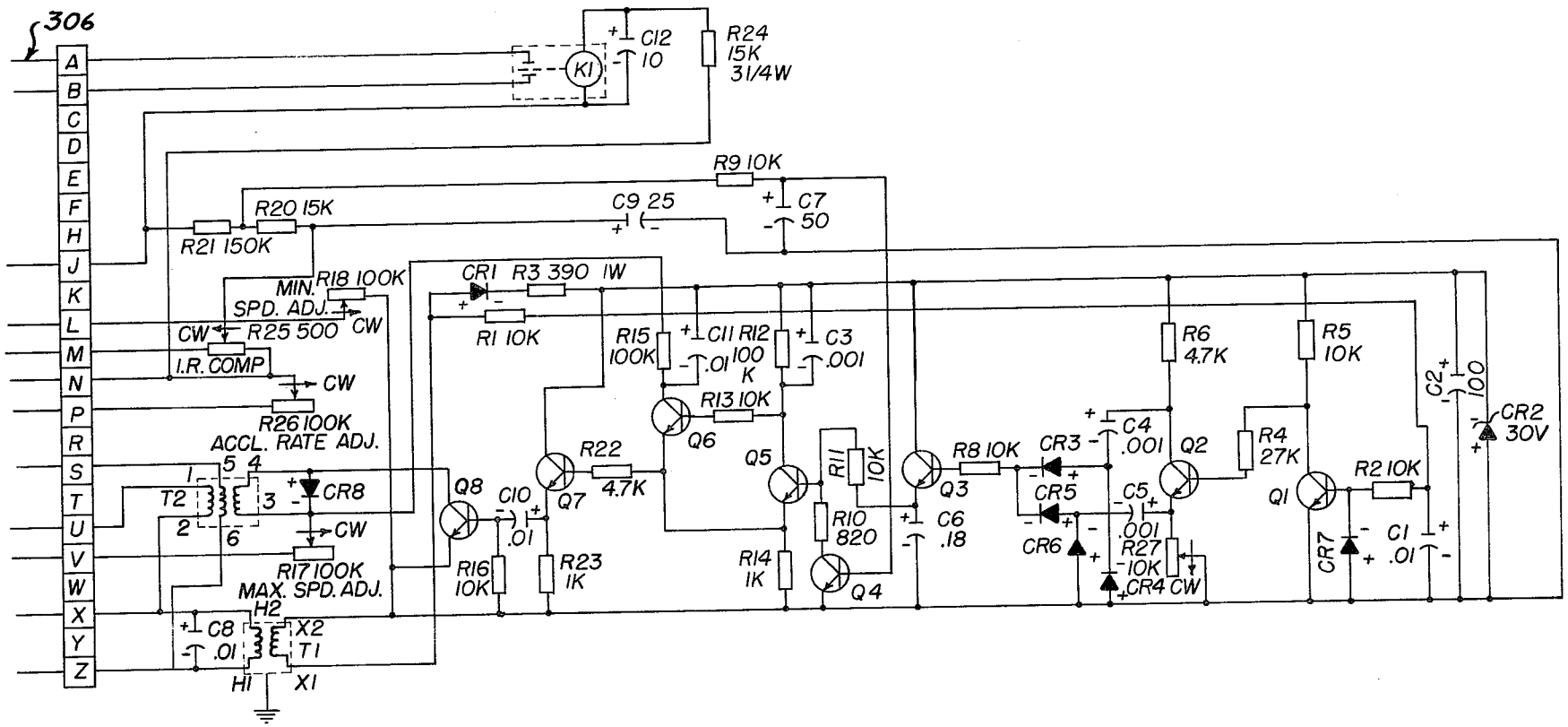
Figures 2, 23B:
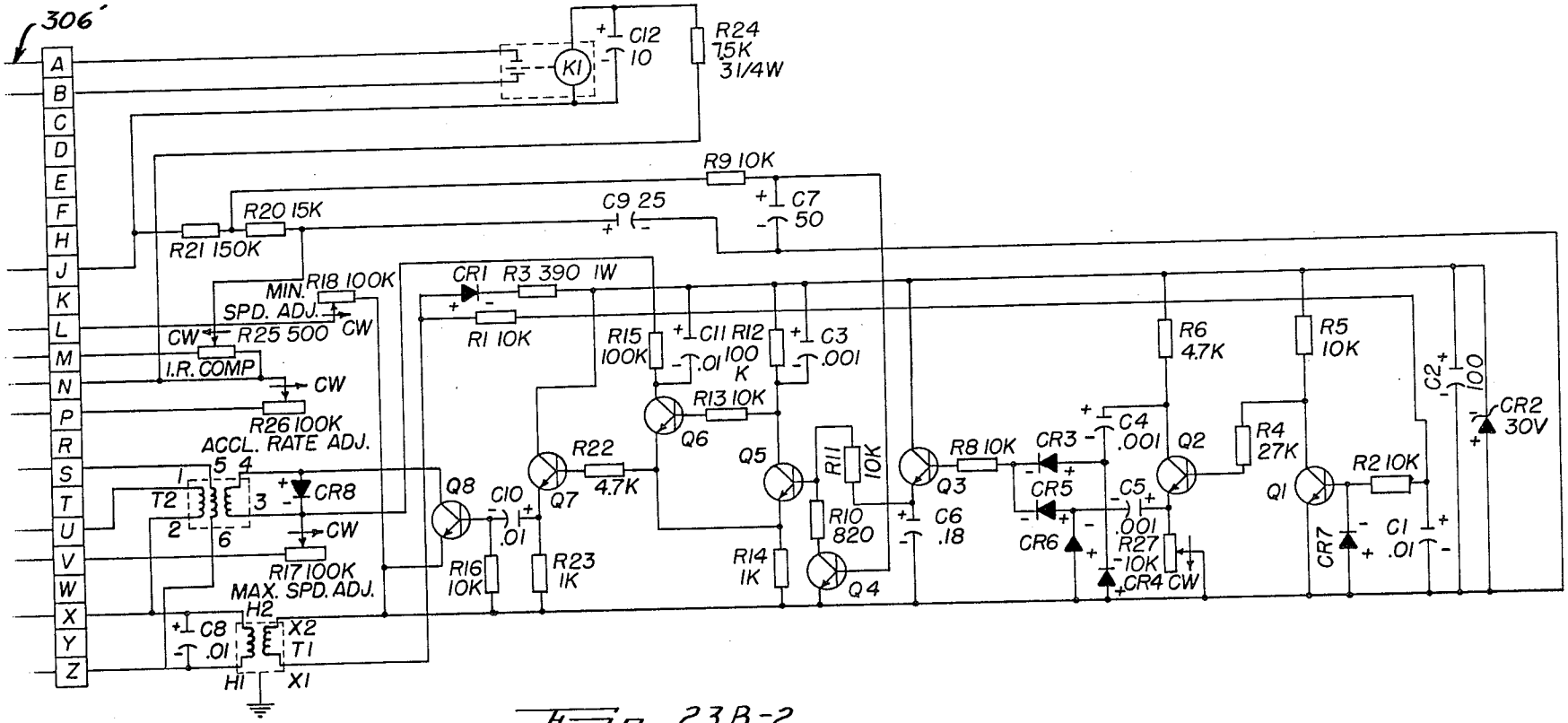
Figure 24A:
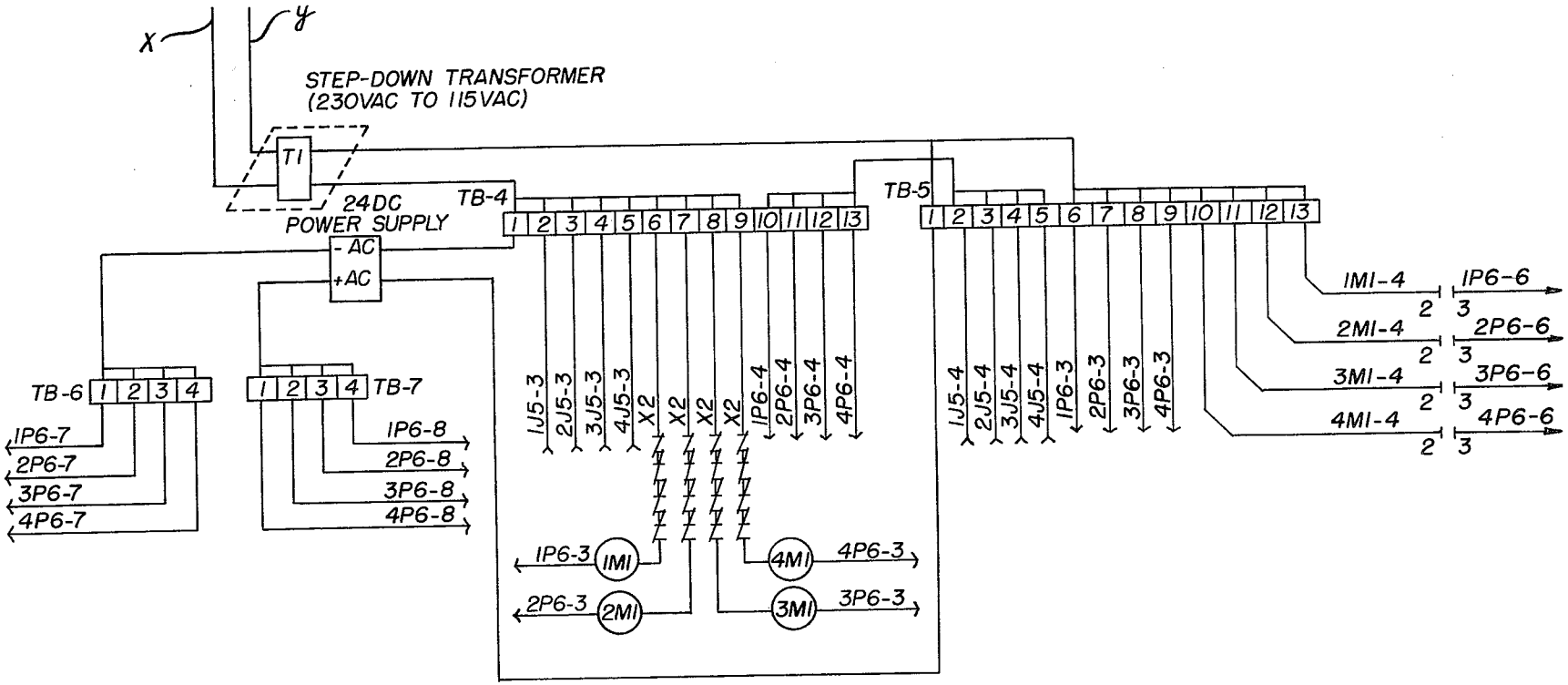
FIG. 24A, 24B is a wiring diagram of an electrical power supply.
Figure 24B:
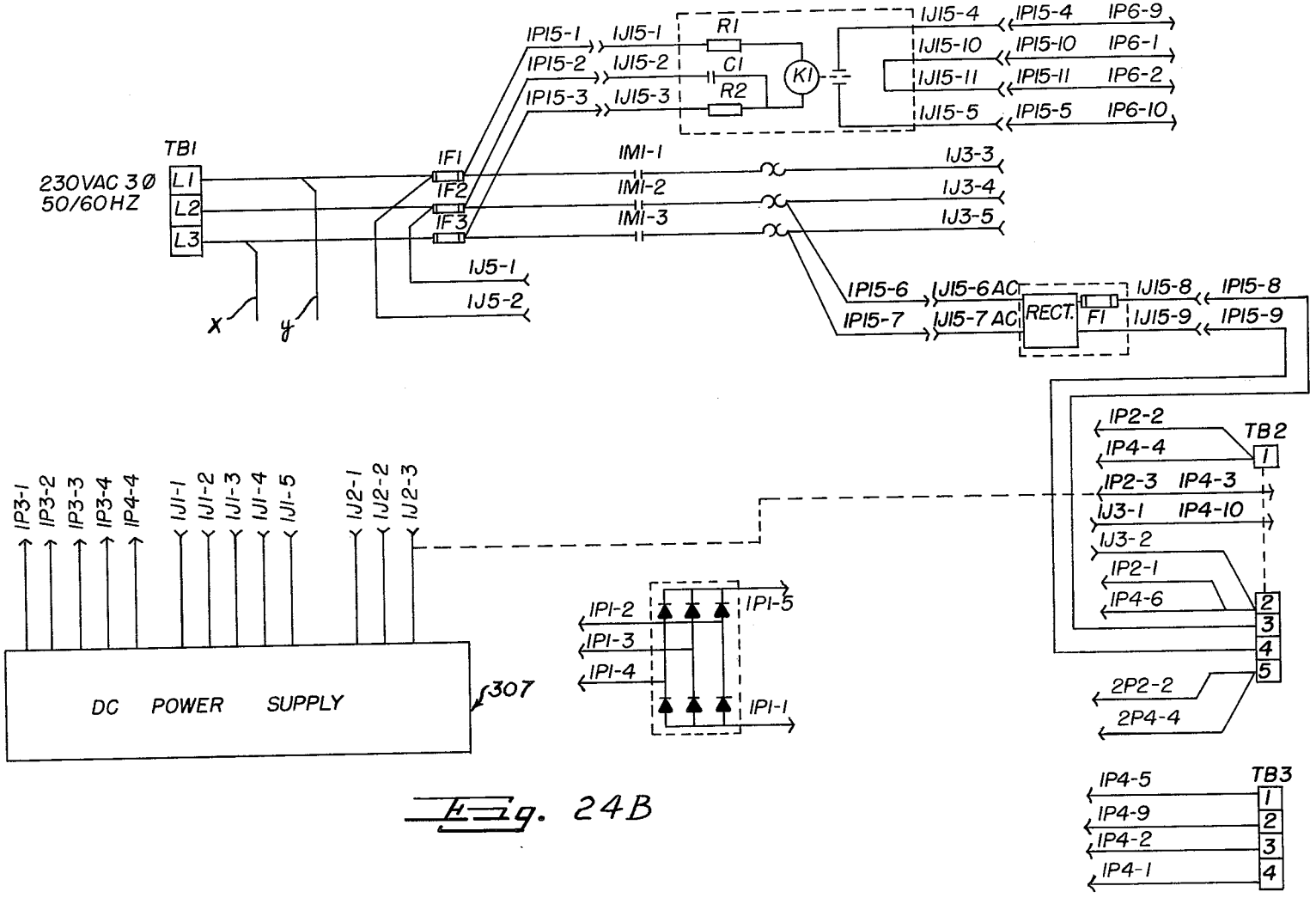

Tachometer generator 280, connected through timing belt 276 to ink applicator roller 42 has terminals connected to terminals TB1-14 (plus) and terminals TB1-15 (minus) as illustrated in FIGS. 18 and 23 of the drawing.

Figure 22:
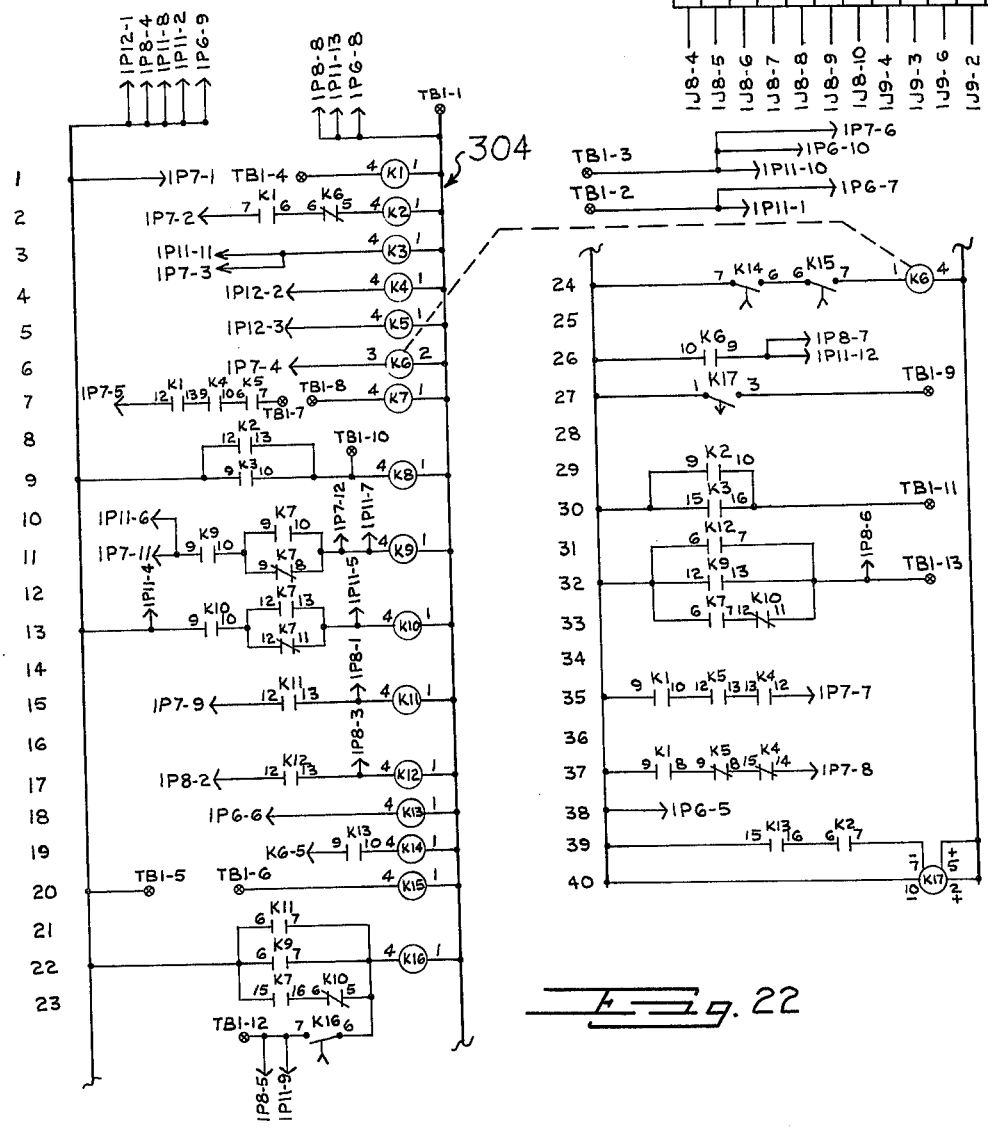
FIG. 22 is a wiring diagram of a relay logic system.

Means is provided for sensing and controlling the thickness of an ink film on vibrator roller 195. In the embodiment of the invention illustrated in FIG. 22 a light source 312 is connected through conductors 314 and 316 to a current regulated power supply 318.

The light source 312 preferably comprises a photoemissive type photodiode, for example, a gallium arsenide infrared light source TIXL 27 supplied by Texas Instruments of Dallas, Texas. The light emitting diode 312 operates in the near infrared range and is oriented to direct a light beam radially of roller 195 toward the surface of an ink film thereon.

A light sensor 320 is oriented at an angle of 45° to the radius of roller 195 and is positioned to receive reflected infrared light emitted from light emitting diode 312. The light sensor 320 preferably comprises a photo-sensitive type photodiode, for example, a silicon planar light sensor TI type H11 supplied by Texas Instruments of Dallas, Texas.

Light sensor 320 is connected through conductors 322 and 324 to a resistance type bridge B having terminals 325, 326, 327, and 328 joined by resistors R1, R2, and R3 and variable resistor P1.

Terminals 325 and 326 of bridge B are connected through conductors 330 and 332 to a voltage regulated power supply 334.

Terminals 327 and 328 of bridge B are connected through conductors 336 and 338 to an operational amplifier 340. Output terminals of amplifier 340 are connected through conductors 342 and 344 to terminals TB1-14 (plus) and terminal T1-15 (minus).

Since a constant current is delivered through the light emitting diode 312, the light reflected to the light sensor 320 is a function of the reflecting capability of the ink film on the surface of roller 195. The reflecting capability of the ink film is a function of the film thickness. As the intensity of the reflected light changes, the speed of metering roller drive motor 100 and consequently the surface speed of metering roller 44 is changed until the ink film on roller 195 is of a desired thickness. The thickness of the ink film can be changed by changing the resistance of variable resistor P1 in the bridge circuit.

It should be noted that tachometer generator 280 and amplifier 340 are connected in parallel.

Tachometer generator 280 delivers an electrical signal tending to maintain a predetermined speed relationship between applicator roller 42 and metering roller 44. However, since the thickness of a film of ink metered through the nip between applicator roller 42 and metering roller 44 is not directly related to the relative surface speeds of the rollers, the output of amplifier 340 when combined with the output of generator 280 will maintain a desired film thickness on the surface of roller 195 at any press speed.

OPERATION

The operation and function of the preferred embodiment of the apparatus hereinbefore described is as follows:

Pressure regulation between the application roller 42 and the plate cylinder 16 is accomplished by rotating on-stop adjustment screw 84.

Pressure between the applicator roller 42 and the metering roller 44 is controlled by rotating adjustment screws 94.

Pressure between the sharp lower edge of doctor blade 118 and the surface of metering roller 44 is controlled by rotating doctor blade adjustment eccentric 116.

Ink is deposited in reservior R, defined between end dams 154 and surfaces of applicator roller 42 and metering roller 44. Referring to FIG. 18, the surfaces of applicator roller 42 and metering roller 44 are disposed in pressure indented relation. The pressure between the rollers, controlled by adjustment of screws 94, forms a restriction through which ink is delivered.

Pressure between the tip of doctor blade 118 and the surface of metering roller 44 is preferably adjusted to meter a thin continuous, uninterrupted, uniform film 44T of ink onto the surface of metering roller 44 which is moving toward the surface of the applicator roller 42. Ink film 44T is preferably thinner than ink film 13 on the surface of applicator roller 42 moving toward the surface of plate cylinder 16. Thus, by adjusting the pressure and consequently the width of the stripe at the nip N between rollers 42 and 44, and by adjusting the relative surface speeds of rollers 42 and 44, and by controlling the thickness of ink film 44T on the surface of metering roller 44; the thickness of the film of ink metered onto the surface of applicator roller 42 can be precisely controlled.

To assure that the temperature of surface of metering roller 44 and the thin film 44T of ink are maintained at a substantially constant temperature, the valve **35*a'* is opened causing liquid to be circulated by pump P through distribution tube 35*c* into the interior of metering roller 44. The flow of liquid L is controlled by temperature activated modulating valve 35*b'*** as hereinbefore described.

It should be appreciated that the function of the ink film 44T is to provide a continuous uniform metering surface at the nip N such that conditions can be established and maintained to permit metering of a uniform film 13 onto the surface of applicator roller 42. The film 44T further provides lubrication at the nip N reducing power required for rotating metering roller 44 in the manner hereinbefore described and illustrated in the drawing.

The presence of the thin film 44T of ink on the surface of metering roller 44 also contributes to precision control of the thickness of the ink film 13 in that the metering apparatus is less sensitive to changes in the speed differential between adjacent surfaces of applicator roller 42 and metering roller 44 than if the surface of metering roller 44 were wiped completely clean. Consequently, the change in speed ratio of applicator roller 42 and metering roller 44 increases as the thickness of ink film 44T is increased to provide a given change in the thickness of ink film 13 on the surface of applicator roller 42. It should further be noted that while nip roller 124 transfers ink from the surface of metering roller 44 which is moving away from the nip N to the surface of applicator roller 42 which is moving toward the nip N, the nip roller 124 also functions to work or mill ink thereby applying physical energy or tension to the molecular structure of the ink improving characteristics of the ink and permitting the ink to be spread in a smooth uniform film. Nip roller 124 maintains ink in the reservior R in motion which maintains the kinematic viscosity substantially constant by maintaining the applied shear stress substantially constant and by maintaining the rate of deformation of the ink substantially constant. It should further be appreciated that the nip roller 124 breaks up and disperses any air pockets or bubbles in the ink while directing ink toward the nip N.

The combined functions of the nip roller 124 and the thin ink film 44T which is maintained at a controlled temperature and velocity permits precise metering and control of ink film 13 under continuous operating conditions. However, when the printing press is speeded up or slowed down, the thickness of film 13 tends to change if the surface speeds of applicator roller 42 and metering roller 44 are maintained in a fixed speed relationship. The thickness of the film of ink on the surface of vibrator roller 195 is proportional to the thickness of ink film 13.

As hereinbefore described the ink film thickness sensing apparatus comprising photocells 312 and 320 deliver an electrical signal to adjust the speed of metering roller drive motor 100 to rotate metering roller 44 at a speed to maintain a prescribed ink film thickness.

Vibrator roller 195 preferably has a hard surface of a suitable material, such as copper. Vibrator rollers 194 and 195 oscillate axially as piston rod 184 reciprocates through cylinder 180.

As hereinbefore described dampening fluid is applied to ink film 13 over dampening fluid metering roller 225 and dampening fluid applicator roller 226.

As the surface of applicator roller 42 moves out of engagement with plate cylinder 16 a film of dampening fluid may remain thereon. Air directed through tube 290 impinges against the surface of applicator roller 42 to facilitate evaporating the dampening fluid prior to movement of the surface through reservoir R.

From the foregoing it should be readily apparent that we have developed ink metering apparatus comprising applicator roller 42 and metering roller 44 arranged in a relationship for forming a uniform film 13 of ink of controlled thickness. Since shear viscosity, pressure, temperature, adhesion and cohesion of ink are controlled, we have eliminated fluxuation of parimeters which effect the thickness of ink film 13.

It should be appreciated that a preferred embodiment of the invention has been described herein and that other and further embodiments of the invention may be devised without departing from the basic concept thereof.

Having described our invention, we claim:

1. Apparatus to meter liquid comprising: a frame; first and second rollers; means rotatably securing said first and second rollers to said frame such that a metering nip is formed between adjacent surfaces of said first and second rollers; first and second pairs of end seal elements, each of said second pair of end seal elements having a convex peripheral surface having a radius of curvature substantially equal to the radius of curvature of said second roller; means urging said first pair of end seal elements into non-rotating, sealing relation with opposite ends of said first roller; means urging said second pair of end seal elements into non-rotating sealing relation with opposite ends of said second roller, said arcuate peripheral surfaces extending outwardly of the ends of said first end seal elements; a pair of end dams each having a flat sealing surface and a concave sealing surface; means urging said flat sealing surfaces into sealing relation with ends of said first pair of end seal elements; means urging said concave sealing surfaces into sealing relation with said convex peripheral surfaces on said second pair of end seal elements; and means to rotate at least one of said first and second rollers.

2. The combination called for in claim 1 with the addition of a resilient peripheral roller surface on one of said first and second rollers; resilient sealing surfaces on one pair of said first and second pairs of end seal elements; means urging said resilient roller surface into pressure indented relation with the other roller; and means urging said resilient sealing surfaces into pressure indented relation with the other pair of end seal elements.

3. The combination called for claim for in wherein said first and second pairs of end seal elements comprise discs having central passages formed therethrough; and axles on ends of said first and second rollers, said axles extending through said passages.

4. The combination called for in claim 3 wherein each of said discs has an annular groove formed in an end surface; and has a lubricant passage communicating with said annular groove; and valve means in said lubricant passage, said valve means being adapted to prevent flow of lubricant from said annular groove into said lubricant passage.

5. The combination called for in claim 3 wherein said resilient sealing surfaces comprise resilient strip material secured about a portion of the peripheral surface on one pair of discs.

6. The combination called for in claim 1 wherein said first roller has a resilient surface and said second roller has a hard heat conductive surface, said second roller having a hollow interior bore; a source of liquid; means to circulate liquid from said source of liquid into said bore; and means to return liquid from said bore to said source of liquid.

7. The combination called for in claim 6 with the addition of means to maintain liquid circulated to said bore at a constant temperature; and flow control means adapted to maintain liquid returning from said bore to said source at a constant temperature.

8. The combination called for in claim 6 wherein said means to circulate liquid into said bore comprises means to distribute flow of liquid longitudinally of said second roller wherein the flow rate of liquid into said bore adjacent ends of said second roller is different from the flow rate of liquid into said bore centrally between ends of said second roller.

9. The combination called for in claim 1 wherein said means to rotate at least one of said first and second rollers is adapted to move adjacent surfaces of said first and second rollers in opposite directions; and with the addition of means to maintain the surface of at least one of said rollers at a substantially constant temperature.

10. The combination called for in claim 9 with the addition of a doctor blade; means urging said doctor blade toward the surface of at least one of said rollers to form a film of controlled temperature and controlled thickness; and means to urge the other roller into pressure relation with a printing plate.

11. The combination called for in claim 10 wherein at least one of said rollers has indentations in the surface, said indentations being of a size to control adhesion of liquid to the surface.

12. The combination called for in claim 9 with the addition of: doctor means arranged to form a film of controlled temperature and controlled thickness on one of said rollers.

13. Apparatus to meter ink to a printing plate comprising: a frame; first and second rollers; means rotatably securing said rollers to said frame; means urging said first roller into pressure indented relation with said second roller to form a nip; means to urge said second roller into pressure indented relation with a printing plate, said first roller having a hollow internal bore; a distribution tube in said bore, said distribution tube having longitudinally spaced apertures, said apertures being arranged such that the flow rate of liquid flowing therefrom into said bore adjacent ends of said first roller is different from the flow rate of liquid into said bore centrally of said first roller; means to deliver liquid to said distribution tube; means to remove liquid from said bore; variable speed drive means to rotate said first roller such that adjacent surfaces of said first and second rollers move in opposite directions; end dams in sealing relation with opposite ends of said first and second rollers forming an ink reservoir above said nip; a doctor blade; and means urging said doctor blade toward the surface of said first roller.

14. Apparatus to meter liquid comprising: a frame; first and second rollers; means rotatably securing said first and second rollers to said frame such that a metering nip is formed between adjacent surfaces of said first and second rollers; first and second pairs of end seal elements, each of said second pair of end seal elements having a convex peripheral surface having a radius of curvature substantially equal to the radius of curvature of said second roller; means urging said first pair of end seal elements into non-rotating, sealing relation with opposite ends of said first roller; means urging said second pair of end seal elements into non-rotating sealing relation with opposite ends of said second roller, a pair of end dams having sealing surfaces; means urging said sealing surfaces into sealing relation with said first and second pair of end seal elements.

15. Apparatus to meter liquid comprising: a frame; first and second rollers; means rotatably securing said rollers to said frame; means urging said first roller into pressure indented relation with said second roller to form a nip, said first roller having a hollow internal bore; means to deliver liquid into said bore; means to remove liquid from said bore; control means to maintain liquid removed from said bore at a constant temperature; variable speed drive means to rotate said first roller such that adjacent surfaces of said first and second rollers move in opposite directions; end dams in sealing relation with opposite ends of said first and second rollers forming a reservoir adjacent said nip; agitator means in said reservoir, said agitator means being adapted to control flow of liquid toward said nip; doctor means arranged to form a film on the surface of said first roller; roller means urged into pressure relation with said second roller; film thickness indicator means adjacent said roller means; speed control means connected to said variable speed drive means; and means operably connected between said film thickness indicator and said speed control means such that the surface speed of the first roller is regulated to maintain a controlled film thickness on said roller means.

16. Apparatus to meter liquid comprising: spaced side frames connectable to opposite sides of the printing press; means pivotally securing said side frames to opposite sides of the printing press; first and second rollers; means rotatably securing said first and second rollers to said side frames; actuating means secured between said side frames and opposite sides of the press to move said side frames between a first position wherein said second roller is in pressure indented relation with the printing plate, and a second position wherein said second roller is spaced from the printing plate; means urging said first roller into pressure indented relation with said second roller to form a nip, said first roller having a hollow internal bore; means to deliver liquid into said bore; means to remove liquid from said bore; variable speed drive means to rotate said first roller such that adjacent surfaces of said first and second rollers move in opposite directions; end dams in sealing relation with opposite ends of said first and second rollers forming a reservoir adjacent said nip; doctor means arranged to form a film on the surface of said first roller; and control means to maintain liquid removed from said bore at a constant temperature.

17. The combination called for in claim 16 wherein said actuating means comprises: an over-center toggle linkage movably secured to said side frame; a stub shaft rotatably secured to said side frame, said stub shaft having an eccentric journal on an end thereof engaging said side frame; and actuator means on said support frame secured to said over-center toggle linkage.

* * * * *